US010935211B2

(12) United States Patent
Castillo et al.

(10) Patent No.: US 10,935,211 B2
(45) Date of Patent: Mar. 2, 2021

(54) LED LUMINAIRE WITH A SMOOTH OUTER DOME AND A CAVITY WITH A RIDGED INNER SURFACE

(71) Applicant: IDEAL Industries Lighting LLC, Durham, NC (US)

(72) Inventors: Mario A. Castillo, New Braunfels, TX (US); Kurt S. Wilcox, Libertyville, IL (US); Andrew Dan Bendtsen, Milwaukee, WI (US); Brian Kinnune, Racine, WI (US); Sandeep Pawar, Elmhurst, IL (US); David P. Goelz, Milwaukee, WI (US)

(73) Assignee: IDEAL INDUSTRIES LIGHTING LLC, Sycamore, IL (US)

( * ) Notice: Subject to any disclaimer, the term of this patent is extended or adjusted under 35 U.S.C. 154(b) by 413 days.

(21) Appl. No.: 14/618,884

(22) Filed: Feb. 10, 2015

(65) Prior Publication Data

US 2015/0345715 A1 Dec. 3, 2015

Related U.S. Application Data

(63) Continuation-in-part of application No. 14/583,415, filed on Dec. 26, 2014, now Pat. No. 10,502,899, and (Continued)

(51) Int. Cl.
*F21V 3/02* (2006.01)
*F21V 5/00* (2018.01)
(Continued)

(52) U.S. Cl.
CPC ..... *F21V 3/02* (2013.01); *F21S 8/043* (2013.01); *F21S 8/086* (2013.01); *F21V 5/002* (2013.01);
(Continued)

(58) Field of Classification Search
CPC ... F21V 3/02; F21V 3/049; F21V 3/04; F21V 8/00; F21V 5/002; F21V 5/00; F21V 23/0464; F21V 23/04; F21V 23/006; F21V 23/00; G02B 6/002; G02B 6/0038; G02B 6/0016; G02B 6/0075; G02B 6/0085;
(Continued)

(56) References Cited

U.S. PATENT DOCUMENTS 2,246,098 A * 6/1941 Jaeckel ..... G02B 3/08 353/38
3,372,740 A 3/1968 Kastovieh et al.
(Continued)

OTHER PUBLICATIONS

Eye Lighting International, LED Distribution Types, available when downloaded on Aug. 12, 2020 from https://eyelighting.com/lighting-technology-education/led-lighting-basics/led-distribution-types (Year: 2020).*

*Primary Examiner* — Andrew Jordan
(74) *Attorney, Agent, or Firm* — J. Clinton Wimbish; Nexsen Pruet, PLLC

(57) ABSTRACT

An optical member includes a curved portion comprising an optically transmissive material. The enclosure has an outer surface and an inner surface opposite the outer surface. At least one light redirection feature protrudes from the inner surface. At least one indentation defined on the outer surface is configured to refract light.

31 Claims, 22 Drawing Sheets

Related U.S. Application Data a continuation-in-part of application No. 14/462,426, filed on Aug. 18, 2014, now Pat. No. 10,379,278, and a continuation-in-part of application No. 14/462,391, filed on Aug. 18, 2014, now Pat. No. 9,513,424, and a continuation-in-part of application No. 14/462,322, filed on Aug. 18, 2014, now Pat. No. 9,632,295.

(60) Provisional application No. 62/009,039, filed on Jun. 6, 2014, provisional application No. 62/005,955, filed on May 30, 2014.

(51) Int. Cl.

| | |
|---|---|
| ***F21S 8/04*** | (2006.01) |
| ***F21S 8/08*** | (2006.01) |
| ***F21V 23/04*** | (2006.01) |
| *F21W 131/10* | (2006.01) |
| *F21W 131/105* | (2006.01) |
| *F21V 23/00* | (2015.01) |
| *F21W 131/103* | (2006.01) |
| *F21V 3/04* | (2018.01) |
| *F21Y 115/10* | (2016.01) |
| *F21Y 105/10* | (2016.01) |

(52) U.S. Cl.

CPC ..... *F21V 23/0464* (2013.01); *F21V 3/049* (2013.01); *F21V 23/006* (2013.01); *F21W 2131/10* (2013.01); *F21W 2131/103* (2013.01); *F21W 2131/105* (2013.01); *F21Y 2105/10* (2016.08); *F21Y 2115/10* (2016.08)

(58) Field of Classification Search

CPC . G02B 6/0095; F21S 8/043; F21S 8/04; F21S 8/086; F21S 8/08; F21Y 2115/10; F21Y 2101/00

See application file for complete search history.

(56) References Cited

U.S. PATENT DOCUMENTS 3,425,056 A * 1/1969 Dawson ..... F21V 5/00 340/815.76
4,371,916 A * 2/1983 De Martino ..... F21S 43/26 362/511
5,081,564 A * 1/1992 Mizoguchi ..... F21S 43/26 362/521
5,103,383 A * 4/1992 Mayhew ..... B60Q 7/00 362/158
5,416,684 A * 5/1995 Pearce ..... F21V 5/00 362/309
5,676,457 A 10/1997 Simon
5,718,497 A * 2/1998 Yokoyama ..... G02B 6/0036 362/23.15
5,839,823 A 11/1998 Hou et al.
5,863,113 A 1/1999 Oe et al.
6,097,549 A * 8/2000 Jenkins ..... B60Q 1/302 359/726
6,264,347 B1 * 7/2001 Godbillon ..... F21S 43/26 362/331
6,443,594 B1 9/2002 Marshall et al.
6,554,451 B1 4/2003 Keuper
6,908,219 B1 * 6/2005 Reiss ..... B60Q 1/302 362/338
7,008,097 B1 3/2006 Hulse
7,021,805 B2 * 4/2006 Amano ..... F21S 48/215 362/307
7,025,482 B2 * 4/2006 Yamashita ..... G02B 6/0018 362/348
7,090,370 B2 8/2006 Clark et al.
7,422,357 B1 * 9/2008 Chang ..... G02B 6/0038 362/602
7,488,093 B1 2/2009 Huang et al.
7,520,641 B2 * 4/2009 Minano ..... F21V 7/0025 362/297
7,534,013 B1 5/2009 Simon
7,566,159 B2 7/2009 Oon et al.
7,593,615 B2 9/2009 Chakmakjian et al.
7,628,508 B2 12/2009 Kita et al.
7,635,205 B2 12/2009 Yu et al.
7,639,918 B2 * 12/2009 Sayers ..... G02B 6/001 362/615
7,641,363 B1 1/2010 Chang et al.
7,736,019 B2 6/2010 Shimada et al.
7,794,127 B2 * 9/2010 Huang ..... H01L 33/54 257/100
7,800,125 B2 * 9/2010 Chen ..... H01L 33/58 257/98
7,810,960 B1 10/2010 Soderman et al.
7,813,131 B2 10/2010 Liang
7,857,619 B2 * 12/2010 Liu ..... A61C 19/004 359/622
7,967,477 B2 * 6/2011 Bloemen ..... F21V 5/045 362/217.04
D641,923 S * 7/2011 Radchenko ..... D26/138
8,253,154 B2 * 8/2012 Jung ..... H01L 33/58 257/100
8,277,106 B2 10/2012 Van Gorkom et al.
8,287,152 B2 10/2012 Gill
8,317,366 B2 11/2012 Dalton et al.
8,330,342 B2 * 12/2012 Bhairi ..... F21V 5/04 313/116
8,348,489 B2 * 1/2013 Holman ..... G02B 6/0028 313/508
8,353,606 B2 1/2013 Jeong
8,382,387 B1 2/2013 Sandoval
8,408,737 B2 4/2013 Wright et al.
8,419,224 B2 4/2013 Wan-Chih et al.
8,434,892 B2 5/2013 Zwak et al.
8,434,893 B2 5/2013 Boyer et al.
8,469,567 B2 * 6/2013 Futami ..... B60Q 1/0041 362/249.02
8,475,010 B2 7/2013 Vissenberg et al.
8,485,684 B2 7/2013 Lou et al.
8,547,022 B2 10/2013 Summerford et al.
8,567,983 B2 10/2013 Boyer et al.
8,573,823 B2 11/2013 Dau et al.
8,593,070 B2 11/2013 Wang et al.
8,696,173 B2 * 4/2014 Urtiga ..... F21V 5/045 362/276
8,702,281 B2 * 4/2014 Okada ..... F21S 48/215 362/307
9,086,217 B2 * 7/2015 Eckert ..... F21V 23/003
9,099,592 B2 8/2015 Derryberry et al.
9,366,396 B2 * 6/2016 Yuan ..... F21K 9/52
9,423,085 B2 * 8/2016 Zahn ..... H01L 33/60
9,448,353 B2 * 9/2016 Holman ..... F21V 5/02
9,574,735 B2 * 2/2017 Benitez ..... F21V 5/04
9,581,751 B2 * 2/2017 Yuan ..... G02B 6/0031
9,593,827 B2 * 3/2017 Ji ..... F21V 5/04
9,632,214 B2 * 4/2017 Streppel ..... F21V 5/002
9,632,295 B2 * 4/2017 Castillo ..... G02B 19/0028
9,709,242 B2 * 7/2017 Benitez ..... F21V 5/04
9,945,527 B2 * 4/2018 Jha ..... F21V 19/003
9,989,213 B2 * 6/2018 Sun ..... F21V 7/0066
2003/0156417 A1 * 8/2003 Gasquet ..... F21V 5/04 362/329
2005/0111235 A1 * 5/2005 Suzuki ..... B60Q 1/2696 362/555
2005/0190564 A1 * 9/2005 Amano ..... F21V 5/045 362/336
2006/0120085 A1 * 6/2006 Hsieh ..... F21V 5/04 362/338
2007/0115569 A1 5/2007 Tang et al.
2007/0152231 A1 * 7/2007 Destain ..... H01L 33/58 257/99
2007/0257610 A1 * 11/2007 Shen ..... H01L 33/54 313/512
2008/0002399 A1 1/2008 Villard et al.

(56) References Cited

U.S. PATENT DOCUMENTS

2008/0030986 A1* 2/2008 Ogawa ..... H01L 25/0753 362/231
2008/0179614 A1* 7/2008 Wang ..... H01L 33/54 257/98
2010/0053959 A1* 3/2010 Ijzerman ..... G02B 6/003 362/235
2010/0238671 A1 9/2010 Catone et al.
2010/0290234 A1* 11/2010 Bierhuizen ..... F21V 5/04 362/311.02
2010/0301360 A1 12/2010 Van De Ven et al.
2010/0302783 A1 12/2010 Shastry et al.
2010/0315833 A1* 12/2010 Holman ..... G02B 6/0028 362/607
2011/0044022 A1 2/2011 Ko et al.
2011/0233568 A1 9/2011 An et al.
2011/0261570 A1* 10/2011 Okada ..... F21S 48/215 362/311.06
2011/0305027 A1 12/2011 Ham
2011/0317436 A1 12/2011 Kuan
2012/0026728 A1 2/2012 Lou et al.
2012/0033445 A1* 2/2012 Desmet ..... G02B 6/0038 362/606
2012/0075870 A1* 3/2012 Kayanuma ..... F21V 5/04 362/311.06
2012/0113537 A1* 5/2012 Minano ..... F21V 7/04 359/834
2012/0120651 A1* 5/2012 Peck ..... F21S 4/008 362/235
2012/0152490 A1 6/2012 Wen et al.
2012/0287654 A1 11/2012 He et al.
2012/0287677 A1 11/2012 Wheatley et al.
2012/0307496 A1 12/2012 Phillips et al.
2012/0320626 A1* 12/2012 Quilici ..... F21S 8/04 362/606
2013/0003363 A1 1/2013 Lu et al.
2013/0128593 A1 5/2013 Luo
2013/0170210 A1 7/2013 Athalye
2013/0194811 A1* 8/2013 Benitez ..... F21V 5/04 362/311.1
2013/0215612 A1 8/2013 Garcia
2013/0229804 A1* 9/2013 Holder ..... F21K 9/00 362/245
2013/0250584 A1 9/2013 Wang et al.
2013/0300310 A1 11/2013 Hu et al.
2013/0343045 A1 12/2013 Lodhie et al.
2013/0343055 A1 12/2013 Eckert et al.
2013/0343079 A1 12/2013 Unger et al.
2014/0001507 A1* 1/2014 Streppel ..... F21V 5/002 257/98
2014/0029257 A1 1/2014 Boyer et al.
2014/0036510 A1* 2/2014 Preston ..... F21V 7/0091 362/296.01
2014/0212090 A1* 7/2014 Wilcox ..... G02B 6/0031 385/27
2014/0226337 A1* 8/2014 Timmers ..... F21V 5/04 362/293
2015/0055369 A1 2/2015 Tarsa et al.
2015/0055371 A1 2/2015 van de Ven et al.
2015/0160396 A1 6/2015 Wilcox et al.
2015/0253488 A1 9/2015 Wilcox et al.
2015/0345715 A1* 12/2015 Castillo ..... F21S 8/043 362/235
2015/0354786 A1* 12/2015 Ji ..... F21V 5/04 315/297

* cited by examiner

LED LUMINAIRE WITH A SMOOTH OUTER DOME AND A CAVITY WITH A RIDGED INNER SURFACE

CROSS REFERENCE TO RELATED APPLICATIONS

The present application claims the benefit of U.S. Provisional Patent Application No. 62/005,955, filed May 30, 2014, entitled "Parking Structure LED Light" and U.S. Provisional Patent Application No. 62/009,039, filed Jun. 6, 2014, entitled "Parking Structure LED Light". This patent application comprises a continuation-in-part of U.S. patent application Ser. No. 14/462,426, entitled "Outdoor and/or Enclosed Structure LED Luminaire for General Illumination Applications, Such as Parking Lots and Structures", filed Aug. 18, 2014, and further comprises a continuation-in-part of U.S. patent application Ser. No. 14/462,391, entitled "Optic Components for Luminaire", filed Aug. 18, 2014, and further comprises a continuation-in-part of U.S. patent application Ser. No. 14/462,322, entitled "Flood Optic", filed Aug. 18, 2014, and further comprises a continuation-in-part of U.S. patent application Ser. No. 14/583,415, entitled "Outdoor and/or Enclosed Structure LED Luminaire", filed Dec. 26, 2014, all owned by the assignee of the present application, and the disclosures of which are incorporated by reference herein.

FIELD OF THE INVENTION

The present subject matter relates to general illumination lighting, and more particularly, to an optic used to collimate light rays generated by light emitting diodes.

BACKGROUND OF THE INVENTION

Large areas of open space, such as a farm stead, a parking lot or deck of a parking garage, or a roadway, require sufficient lighting to allow for safe travel of vehicles and persons through the space at all times including periods of reduced natural lighting, such as nighttime, rainy, or foggy weather conditions. A luminaire for rural areas, an outdoor parking lot or covered parking deck, a roadway, etc. must illuminate a large area of space in the vicinity of the luminaire while controlling glare so as not to distract drivers. In some applications such as roadway, street, or parking lot lighting, it may be desirable to illuminate certain regions surrounding a light fixture while maintaining relatively low illumination of neighboring regions thereof. For example, along a roadway, it may be preferred to direct light in a lateral direction parallel with the roadway while minimizing illumination in a longitudinal direction toward roadside houses or other buildings. Still further, such a luminaire should be universal in the sense that the luminaire can be mounted in various enclosed and non-enclosed locations, on poles or on a surface (such as a garage ceiling), and preferably present a uniform appearance.

Advances in light emitting diode (LED) technology have resulted in wide adoption of luminaires that incorporate such devices. While LEDs can be used alone to produce light without the need for supplementary optical devices, it has been found that optical modifiers, such as lenses, reflectors, optical waveguides, and combinations thereof, can significantly improve illumination distribution for particular applications. Improved consistency in the manufacture of LEDs along with improvements in the utilization of mounting structures to act as heat sinks have resulted in luminaires that are economically competitive and operationally superior to the conventional incandescent and fluorescent lighting that has been the staple of the industry for decades. As the use of LEDs has matured from their use in warning and other signals to general lighting fixtures, it has become necessary to develop optics that allow for the dispersion of the harsh, intensely concentrated beam of light emitted by the LED into a softer, more comfortable illumination that presents a uniform and even appearance.

One way of attaining a more uniform appearance is to control the light rays generated by the LEDs so as to redirect the light rays through and/or out of an optic so that the light presents a uniform appearance when it exits the optic. Redirecting light through the optic can be accomplished through the use of refractive surfaces at a refractive index interface.

SUMMARY OF THE INVENTION

According to one embodiment, an optical member includes an enclosure comprising an optically transmissive material. The enclosure has an outer surface and an inner surface opposite the outer surface. At least one light redirection feature protrudes from the inner surface. At least one indentation defined on the outer surface is configured to refract light.

According to another aspect, an optical member includes a base, a curved surface extending from the base and including an outer surface, an inner surface opposite the outer surface, and a plurality of light redirection features disposed on the inner surface. An LED package comprising a plurality of dies enclosed in a single encapsulant.

According to a further aspect, a lighting device includes a housing and a light source. The housing comprises a base, a plurality of fins extending between a central wall and an outer wall on a first surface of the base, and a cavity extending between an outer edge of the first surface and the outer wall. The light source is mounted to the second surface of the base.

According to another aspect, a lighting device includes a housing and a cover adapted to be disposed on the housing comprising a prong at a first end and a tab at a second end opposite the first end. The housing includes an opening configured to receive the prong of the cover and a ledge configured to receive the tab such that the cover is secured to the housing.

Other aspects and advantages of the present invention will become apparent upon consideration of the following detailed description and the attached drawings wherein like numerals designate like structures throughout the specification.

DETAILED DESCRIPTION

Figure 1:
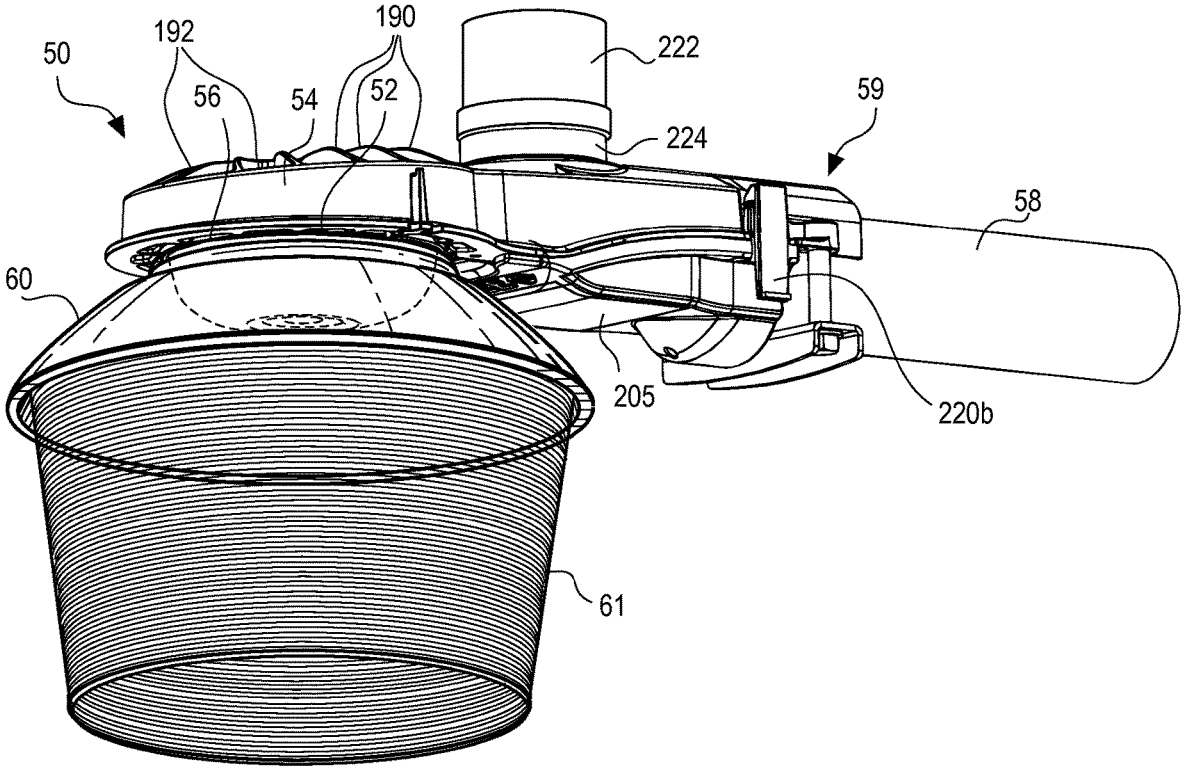
FIG. 1 is an isometric view taken from below of a luminaire incorporating an optical member.
Figure 1A:
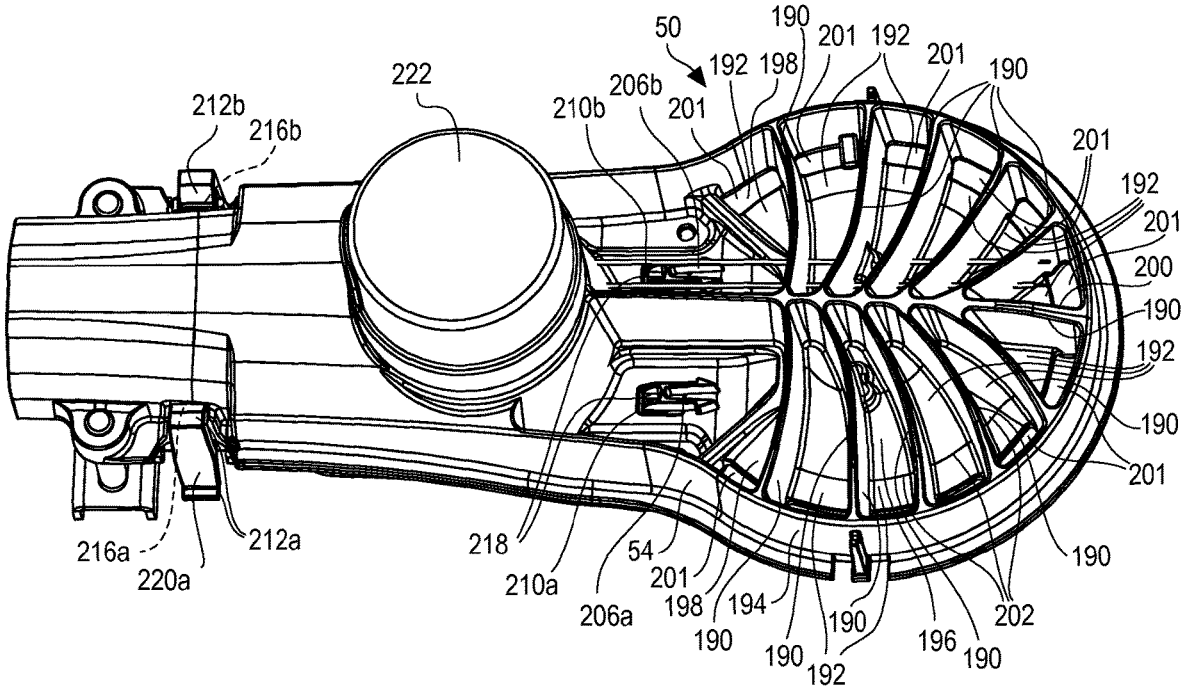
FIG. 1A is an isometric view taken from above of the luminaire of FIG. 1.
Figure 2:
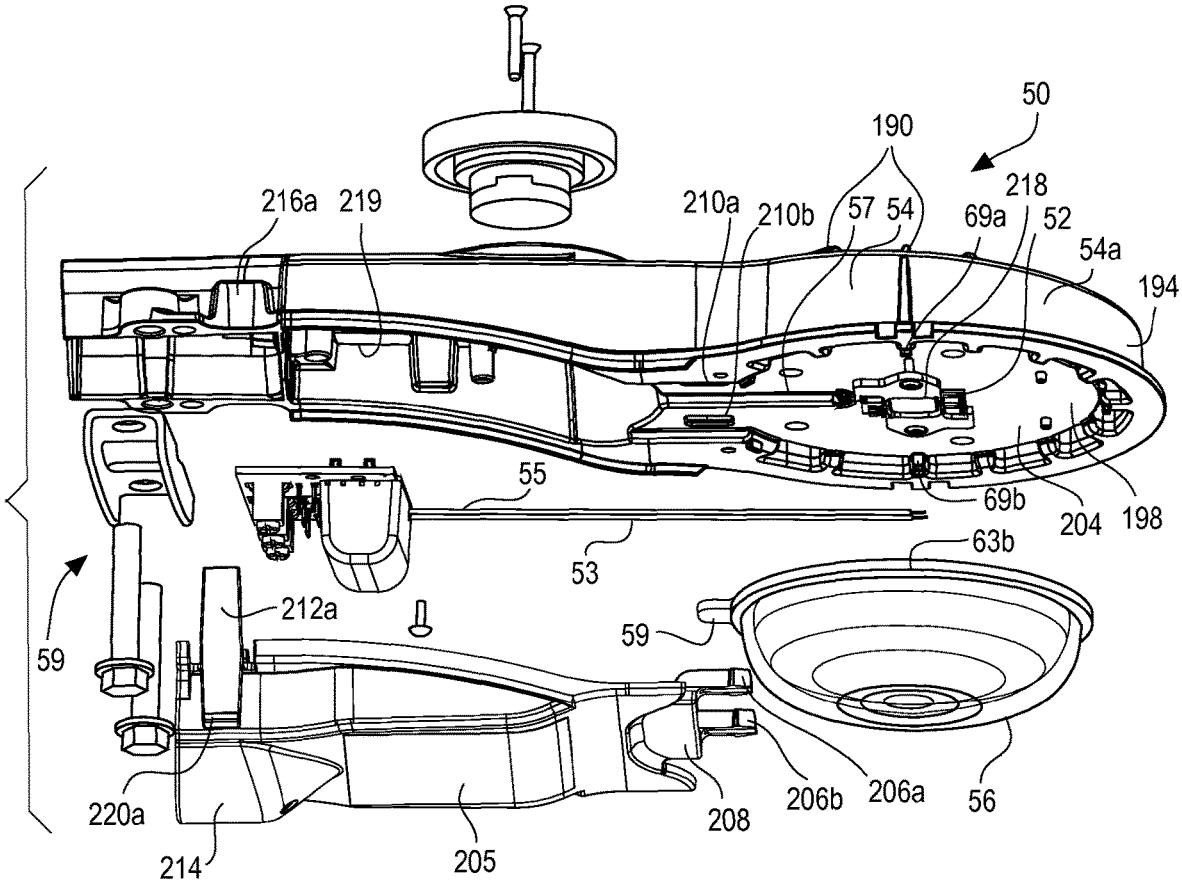
FIG. 2 is an exploded isometric view taken from below of a luminaire incorporating an optical member.

Disclosed herein is luminaire 50 for general lighting, such as illumination of an open or large enclosed space, for example, in a rural setting, a roadway, a parking lot or structure, or the like. Referring to FIGS. 1, 1A, and 2, the luminaire 50 includes a light source such as one or more LED element(s) or module(s) 52 disposed in a housing 54 having a transparent optical member 56 and a cover 205 secured thereto. The luminaire 50 is adapted to be mounted on a device or structure, for example, on an outdoor pole or stanchion 58 and retained thereon by a clamping apparatus 59. The luminaire 50 may further include an optional reflector 60 and/or an optional shroud 61 secured in any suitable fashion about the optical member 56. The luminaire 50 may also include an ambient light sensor 222 mounted in a receptable 224 that acts as a switch such that, when the level of ambient light drops below a predetermined threshold, an electrical path is established by the sensor 222 thereby causing the luminaire 50 to illuminate.

Each LED element or module 52 may be a single white or other color LED chip or other bare component, or each may comprise multiple LEDs either mounted separately or together on a single substrate or package to form a module including, for example, at least one phosphor-coated LED either alone or in combination with at least one color LED, such as a green LED, a yellow LED, a red LED, etc. In those cases where a soft white illumination with improved color rendering is to be produced, each LED element or module 52 or a plurality of such elements or modules 52 may include one or more blue shifted yellow LEDs and one or more red LEDs. The LEDs may be disposed in different configurations and/or layouts as desired. Different color temperatures and appearances could be produced using other LED combinations, as is known in the art. In one embodiment, each element or module comprises any LED, for example, an MT-G LED incorporating TrueWhite® LED technology or as disclosed in U.S. patent application Ser. No. 13/649,067, filed Oct. 10, 2012, entitled "LED Package with Multiple Element Light Source and Encapsulant Having Planar Surfaces" by Lowes et al., the disclosure of which is hereby incorporated by reference herein, as developed and manufactured by Cree, Inc., the assignee of the present application. If desirable, a side emitting LED disclosed in U.S. Pat. No. 8,541,795, filed Oct. 10, 2005, entitled "Side-Emitting Optical Coupling Device" by Keller et al., the disclosure of which is incorporated by reference herein, as developed and manufactured by Cree, Inc., the assignee of the present application, may be utilized. In some embodiments, each LED element or module 52 may comprise one or more LEDs disposed within a coupling cavity with an air gap being disposed between the LED element or module 52 and a light input surface. In any of the embodiments disclosed herein each of the LED element(s) or module(s) 52 preferably have a lambertian or near-lambertian light distribution, although each may have a directional emission distribution (e.g., a side emitting distribution), as necessary or desirable. More generally, any lambertian, symmetric, wide angle, preferential-sided, or asymmetric beam pattern LED element(s) or module(s) may be used as the light source.

Figure 2A:
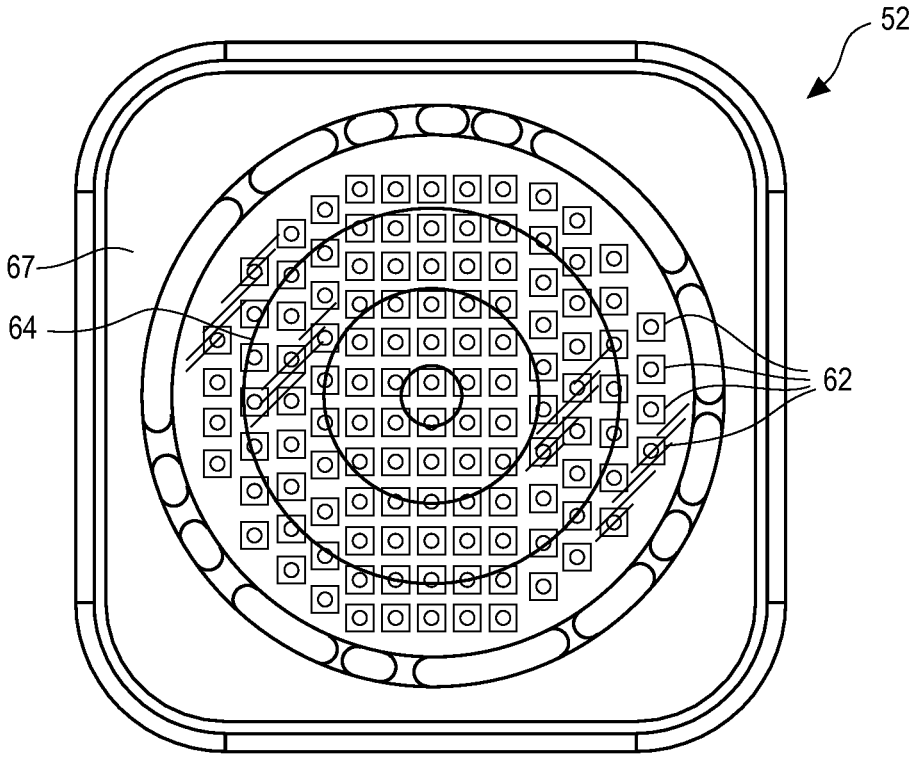
FIG. 2A is a bottom elevational view of an LED element or module.

In one embodiment, the LED package or element 52 may comprise a multi-die LED package, as shown in FIG. 2A. The multi-die package includes at least 40 dies 62 disposed under a single encapsulant or other primary optic 64 on a circuit board 67. In other embodiments, the multi-die package may include 80 dies, or 120 dies, or any number of dies as desired. The optical member 56 may be used with a relatively large LED package having a diameter from about 12.5 mm to about 30 mm, preferably from about 17.5 mm to about 25 mm. In one embodiment, the lighting device 50 may include a module or element as disclosed in U.S. Application 62/088,375, filed Dec. 5, 2014, entitled "Voltage Configurable Solid State Lighting Apparatuses, Systems, and Related Methods", the disclosure of which is hereby incorporated by reference herein, as developed and manufactured by Cree, Inc., the assignee of the present application. In other embodiments, the LED package may include a plurality of individual LED dies wherein each die has an associated encapsulant. The electrical components of the luminaire 50 are described in greater detail in copending U.S. application Ser. No. 14/618,819 entitled "LED Luminaire," filed contemporaneously herewith, owned by the assignee of the present application and the disclosure of which is hereby incorporated by reference herein.

Referring to FIGS. 1, 1A, and 2, the housing 54 includes a plurality of tapered fins 190, a plurality of cavities 192 adjacent and between the fins 190, and an outer wall 194 surrounding the fins 190 and the cavities 192 to provide thermal management of the LED element or module 52. Specifically, the outer wall 194 of the housing 54 is disposed about and at least partially surrounds a first surface 196 of a base 198 (seen in FIG. 2). Each fin 190 extends between a tapered central wall 200 and the outer wall 194. Each cavity 192 extends into an associated space 201 between an outer edge 202 of the first surface 196 and the outer wall 194 and between adjacent fins 190. Each space 201 comprises a void or flow through channel that allows convective air flow therethrough for cooling purposes, and further allows fluid flow to drain rainwater. The first surface 196 slopes to the outer edge 202 such that a thickness of the base 198 near the central wall 200 is greater than a thickness of the base 198 near the outer edge 202 thereof to promote water drainage. The LED element or module 52 is mounted on a second surface 204 of the base 198 opposite the first surface 196. During operation, heat is dissipated as air flow carries heat produced by the LED element or module 52 through the spaces 201 and cavities 192 and along the surfaces of the fins 190, the outer wall 194, and the central wall 200. Other heat dissipation means may also be used.

While ten fins 190 are shown as curved and extending from a substantially linear central wall 200 and the outer wall 194 is shown as being substantially circular in shape, this need not be the case. Thus, for example, fewer or more than ten fins might be used, two or more central walls might be included, or the central wall 200 may be partially or entirely omitted. Alternatively or additionally, some or all of the fins 190 may be linear or be of another shape, the central wall 200 may be curved or some other shape, the outer wall 194 may be square or rectangular or some other shape, and/or the sizes and/or shapes of the cavities and/or the spaces 201 may be varied, as desired. One or more of the fins 190, the outer wall 194, and/or the base 198 may be continuous or discontinuous. Preferably, the fins 190, the outer wall 194, the base 198, and the other elements of the housing 154 are made of uncoated aluminum or another suitable material and are integrally formed.

In the embodiment illustrated in FIGS. 1 and 2, the cover 205 attaches to the housing 54 without the need for separate fastening components. As shown in FIG. 2, first and second prongs 206*a*, 206*b* extending from a first end 208 of the cover 205 are received by first and second openings 210*a*, 210*b* in the housing 54. First and second tabs 212*a*, 212*b* extending from a second end 214 of the cover 205 opposite the first end 208 includes first and second protrustions 213*a*, 213*b*, respectively, that snap-fit about respective first and second ledges 216*a*, 216*b* of the housing 54. During assembly and installation, the first and second prongs 206, 206*b* of the cover 205 are inserted into the first and second openings 210*a*, 210*b* of the housing 54 and the cover is allowed to hang freely from the prongs 206 and yet be movable about an axis of rotation 218. Thereafter, wires may be attached to components in a compartment 219 (seen in FIG. 2) as the cover 205 is hanging freely from the housing 54. Once connections have been made, the cover 205 may be pivoted about the axis of rotation 218 until the first and second tabs 212*a*, 212*b* of the cover 205 snap over the first and second ledges 216*a*, 216*b* of the housing 54. To remove the cover 205, first and second surfaces 220*a*, 220*b* opposite first and second tabs 212*a*, 212*b*, respectively, may be pushed together such that the first and second tabs 212*a*, 212*b* are moved from interfering relationship with the first and second ledges 216*a*, 216*b* of the housing 54 and the cover 205 may be pivoted about the point of rotation 218. In other embodiments, additional fastening components such as screws and/or pins may be used to secure the cover 205 to the housing 54.

Figure 3:
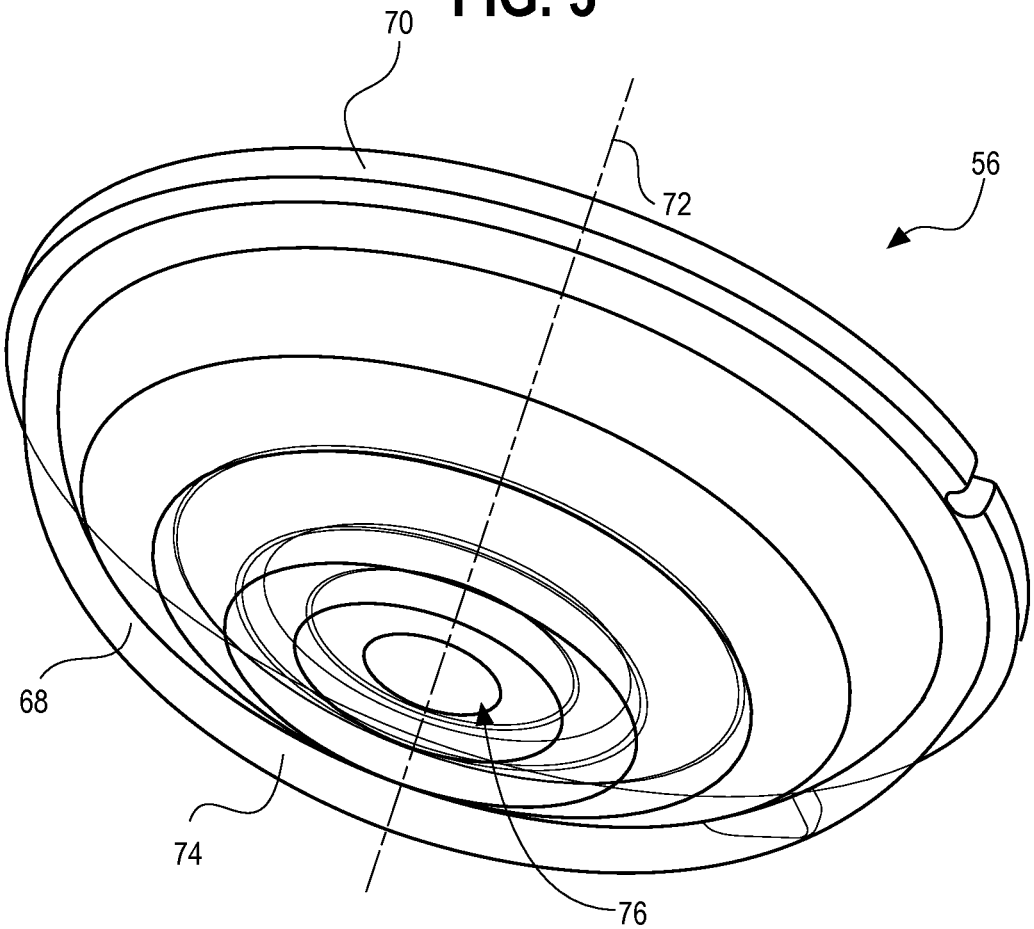
FIG. 3 is an isometric view from below of an embodiment of an optic.

Referring to FIG. 2, the optical member or enclosure 56 is disposed about the LED package(s) or element(s) 52 to produce a desired light distribution having a desired lumen output level. In the embodiment shown in FIG. 3, the optical member 56 comprises a curved portion 68 extending from a base 70. The curved portion 68 is symmetric about a central axis 72. An outer surface 74 of the curved portion 68 includes at least one indentation 76 configured to refract light away from the central axis 72. More specifically, the outer surface 74 is defined by a first portion 77 (FIG. 7) having a frustoconical shape and a second portion 79 (FIG. 7) defining a "free form" or "spline curvature." "Spline curvature" refers to the design of a surface having varied curvature to enable greater control over the angles and/or spread of the light rays as the rays strike the surface. In other embodiments, the outer surface may by defined by a specific equation, a curve determined by iteratively plotting the points using a differential or quasi-differential equation, and/or a free form curve derived by any methodology, such as empirically, or a combination thereof. The indentation 76 of the illustrated embodiment is defined by first, second, and third planar surfaces 78, 80, 82 (FIGS. 5 and 8) that approximate a curve 84 (FIG. 8). Each planar surface 78, 80, 82 (FIGS. 5 and 8) has a frustoconical shape concentric about the central axis 72. In some embodiments, the indentation 76 may comprise a planar surface, a curved surface, a free form surface, or a combination thereof. In the illustrated embodiment, the slope of the outer surface 74 varies smoothly (in that the change in slope is gradual or minor relative to distance), although discrete light extraction and/or redirection features (including discontinuous features) may be formed thereon as desired to produce a desired light distribution.

Figure 4:
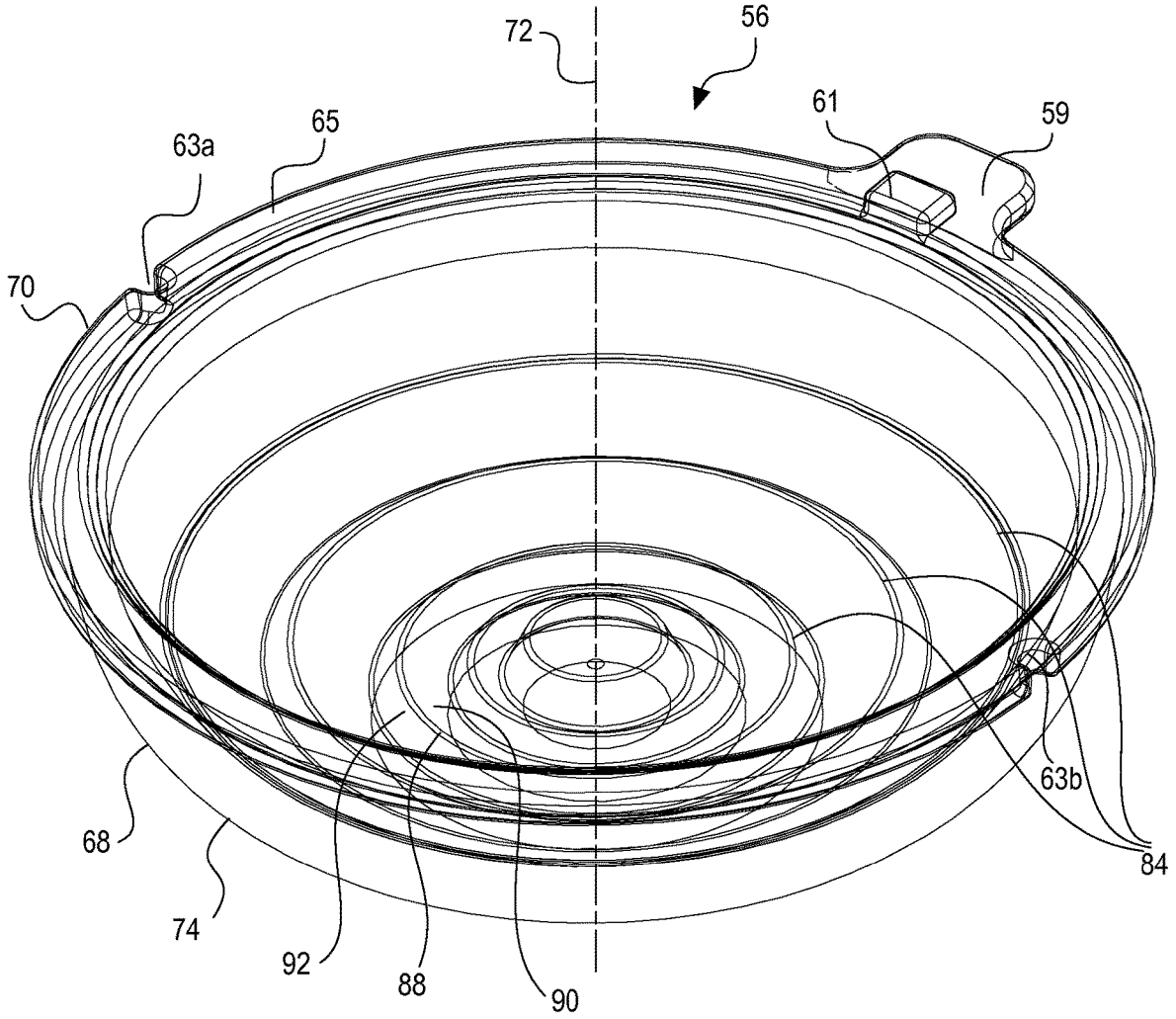
FIG. 4 is an isometric view from above of the embodiment of FIG. 3.
Figure 6:
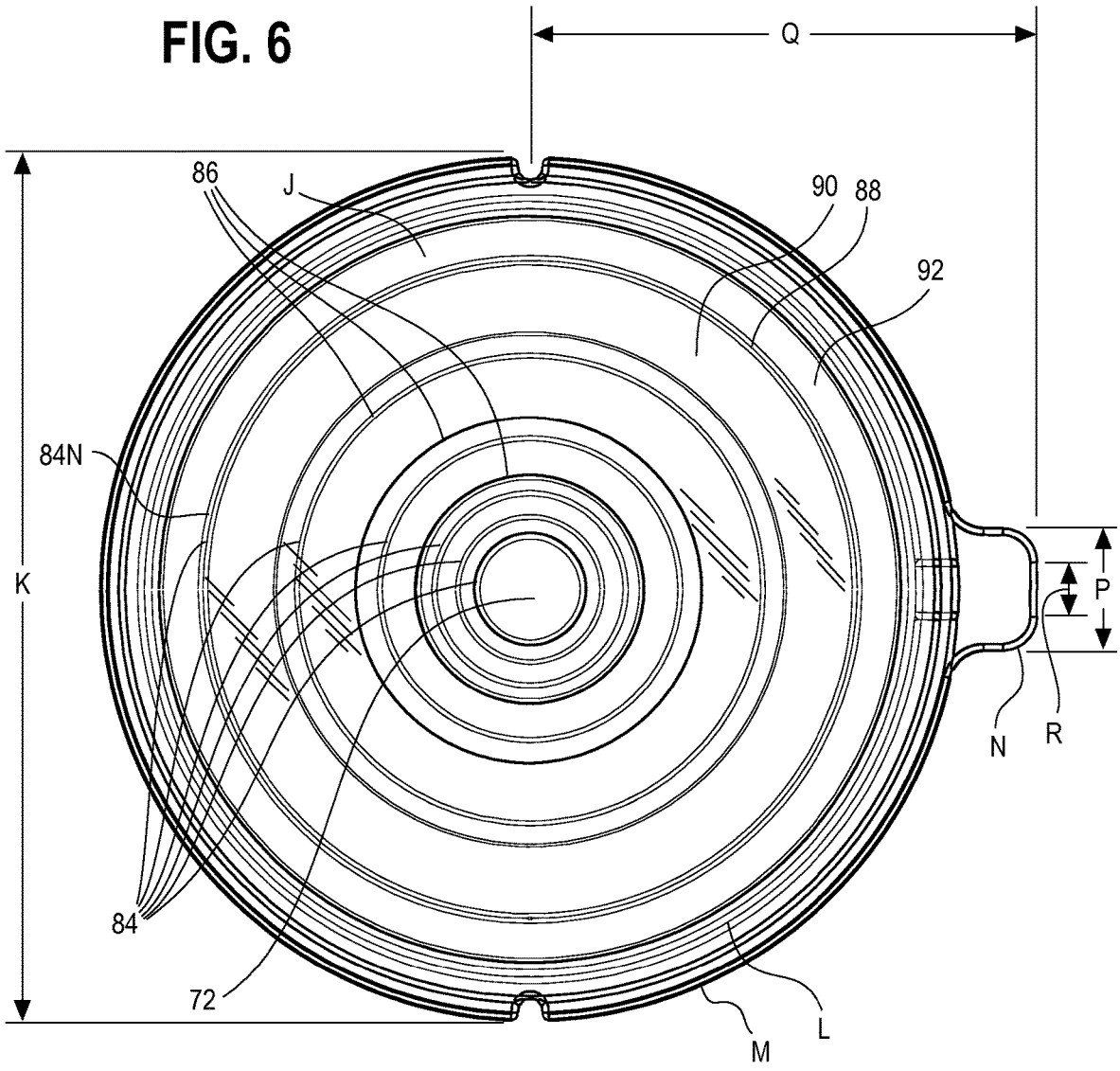
FIG. 6 is a plan view of the embodiment of FIG. 3.

Referring to FIGS. 4 and 6, the optical member 56 includes a plurality of light redirection features 84, each having an annular shape that is also concentric about the central axis 72, protruding from an inner surface 86 of the curved portion 68 opposite the outer surface 74. Further, the inner surface 86 is preferably symmetric about the central axis 72. In other embodiments, each redirection feature and/or the inner surface 86 may have an annular shape that is concentric about an axis other than the central axis 72, and/or the optical member 56 may include at least one light redirection feature 84 having a rounded or planar shape, or a plurality of discrete light direction features approximating an annular shape. Still further, the light redirection features may have other shapes, including shapes that extend fully or partially about a center or other point or feature, and/or shapes that are symmetric or asymmetric, smooth or discontinuous, one or more shapes defined by a specific equation, a shape determined by iteratively plotting points using a differential or quasi-differential equation, and/or a free form shape derived by any methodology, such as empirically, or a combination thereof, etc. Further, in some embodiments, adjacent light redirection features 84 distal to the central axis 72 may be spaced farther apart than adjacent light features 84 proximal to the central axis 72. In other embodiments, adjacent light redirection features 84 distal to the indentation 76 may be spaced farther apart than adjacent light features 84 proximal to the indentation 76.

The optical member 56 substantially redirects the primarily Lambertian distribution of light developed by the LED package 52. Each light redirection feature 84 of the embodiment illustrated in FIGS. 6 and 7 has a ridge-shape configured to refract light in this regard. The ridge-shape of the light redirection features shown in FIGS. 6 and 7 each include a ridge 88 defined by an inner feature surface 90 closer to the central axis 72 and an outer feature surface 92. The light developed by the LED package 52 is incident on the light redirection features 84 and may be refracted toward the outer surface 74 so that the light passes through the optical member 56 to the outer surface 74 where the light exits the optical member 56. The outer surface 74 may be domed and comprise an indentation 76 configured to further refract the light (e.g., away from the central axis 72) upon exiting the optical member 56. The ridge 88 may be filleted as seen in cross section having a radius of curvature of less than about 1.0 mm, preferably less than 0.75 mm, and most preferably less than 0.5 mm. As seen in FIG. 8, the inner feature surface may have a finite radius of curvature along a first extent 94 between the inner surface 86 and the ridge 88. The outer feature surface 92 may be planar along a second extent 96 between the inner surface 86 and the ridge 88. The first and second extents 94, 96 may have a curved surface, a planar surface, and/or a combination thereof, and the curvature may vary from one light redirection feature 84 to another. A portion 98 of the inner surface 86 that extends between the outermost light redirection feature 84 and the base 70 may have a finite radius of curvature.

During assembly of the luminaire 20, the circuit board 67 of the LED package 52 is mounted by any suitable means, such as a bracket with fasteners and/or an adhesive material, for example, a UV curable silicone adhesive, on the second surface 204 of the housing 54, and the optical member 56 is secured to the housing 54 about the LED package 52 by any suitable means, such as a UV curable silicone adhesive or other adhesive. As seen in FIG. 2, wires 53 extend along and inside a channel 57 formed in the housing 54 and connect the LED package 52 to a further circuit board 55 located outside of the optical member 56 and disposed inside a housing 54 of the luminaire 50. The optical member 56 includes a tab 59 outwardly extending from the base 70 that is positioned over the wires 53 disposed in the channel 57. Referring to FIG. 4, a stub 61 extending from the base 70 adjacent the tab 59 applies pressure to the wires 53 in the channel 57 when the luminaire 50 is assembled. The tab 59 and stub 61 protect the wires 53 and channel 57 from elements such as water. Two locating slots 63*a*, 63*b*, each having a semi-circular cylindrical shape, are disposed along an outer edge 65 of the base 70 opposite to one another and equidistant from the tab 59. The locating slots 63*a*, 63*b* receive protrusions 69*a*, 69*b* (FIG. 2) extending from the second surface 204 of the housing 54. An adhesive material such as a UV curable silicone adhesive disposed on the second surface 2014 of the housing 54 secures the optical member 56 thereto.

The material(s) of the optical member 56 preferably comprises optical grade materials that exhibit refractive characteristics such as glass and/or polycarbonate, although other materials such as acrylic, air, molded silicone, and/or cyclic olefin copolymers, and combinations thereof, may be used. Further, the materials may be provided in a layered arrangement to achieve a desired effect and/or appearance. Preferably, although not necessarily, the optical member 56 is solid, although the optical member 56 may have one or more voids or discrete bodies of differing materials therein. The optical member 56 may be fabricated using procedures such as molding, including glass and/or injection/compression molding, or hot embossing, although other manufacturing methods such may be used as desired. In one embodiment, the optical member 56 comprises glass and is manufactured using glass molding techniques.

Figure 5:
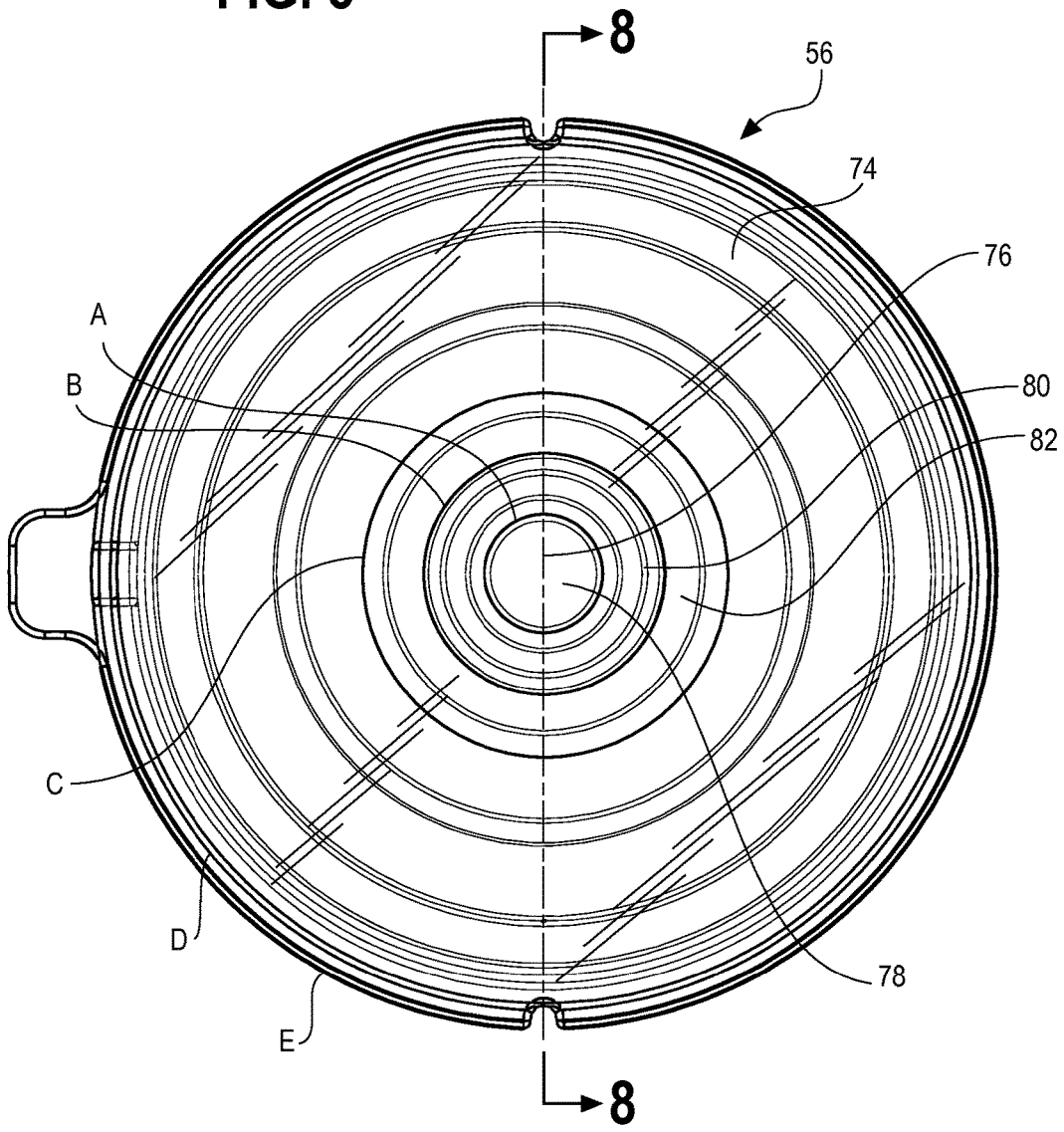
FIG. 5 is a bottom elevational view of the embodiment of FIG. 3.
Figure 7:
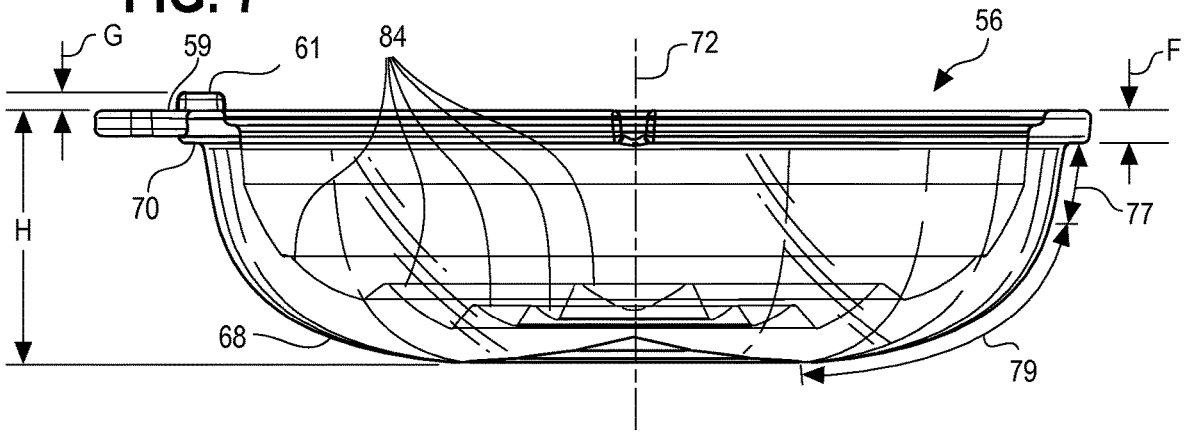
FIG. 7 is a side elevational view of the embodiment of FIG. 3.
Figure 8:
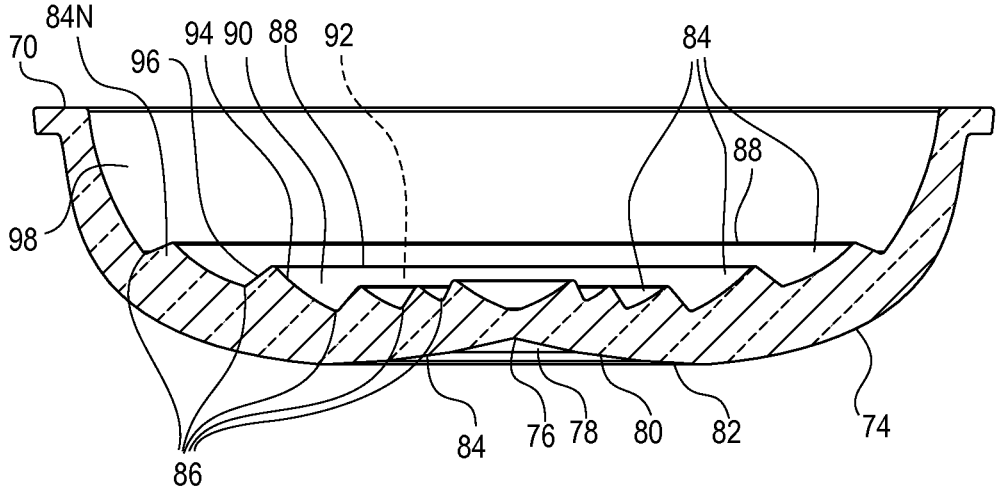
FIG. 8 is a sectional view taken generally along the lines 8-8 of FIG. 5.
Figure 8A:
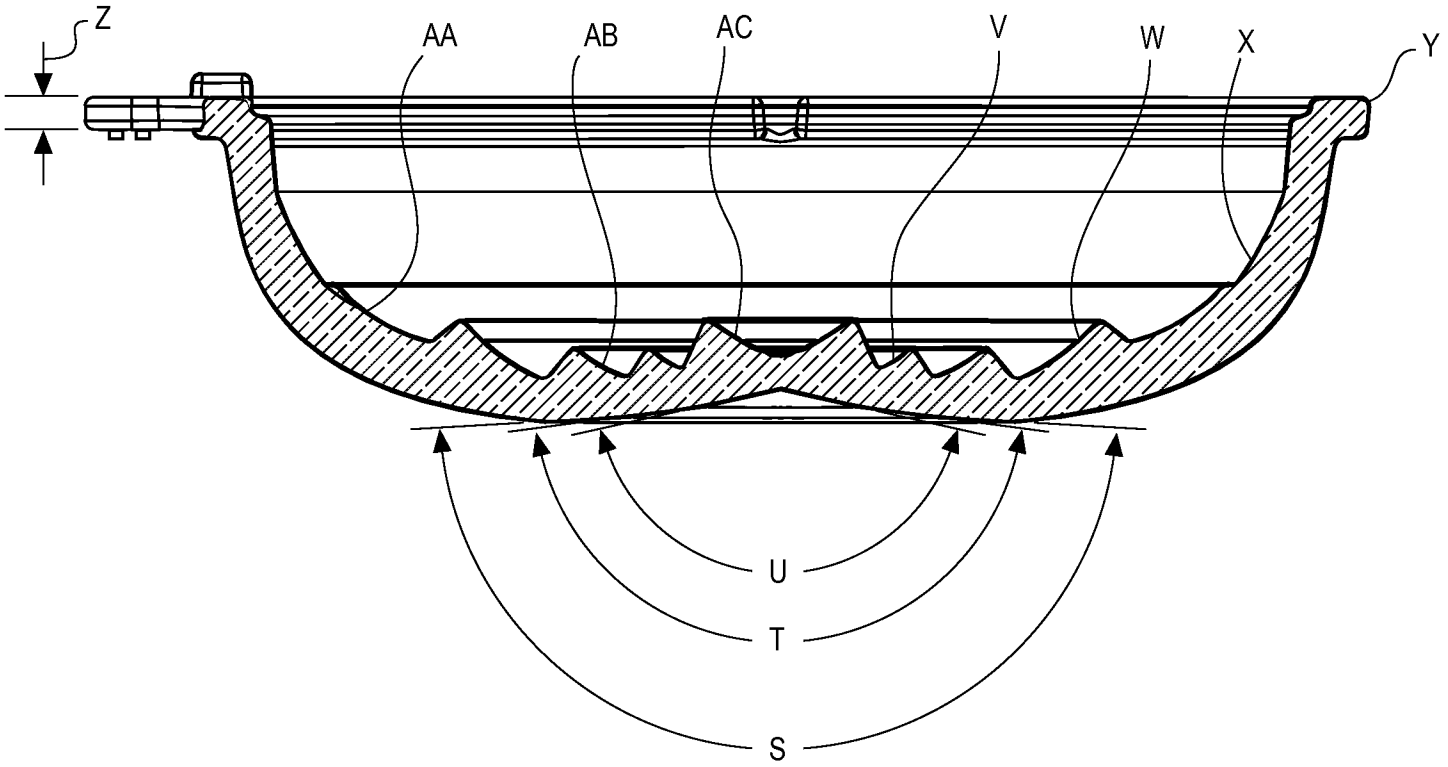
FIGS. 8A and 8B are sectional views identical to FIG. 8 illustrating sample dimensions for the optical member.
Figure 8B:
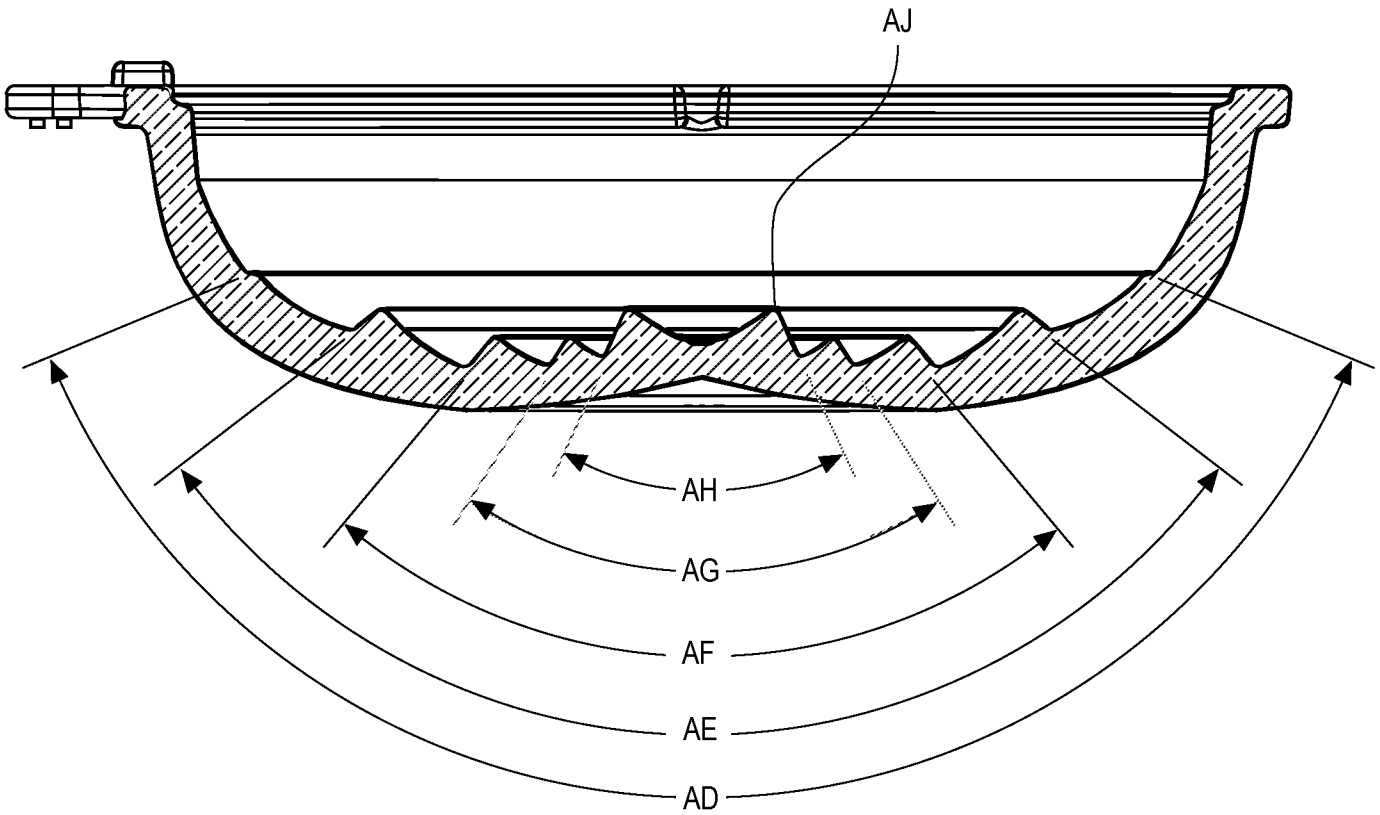
Figure 9:
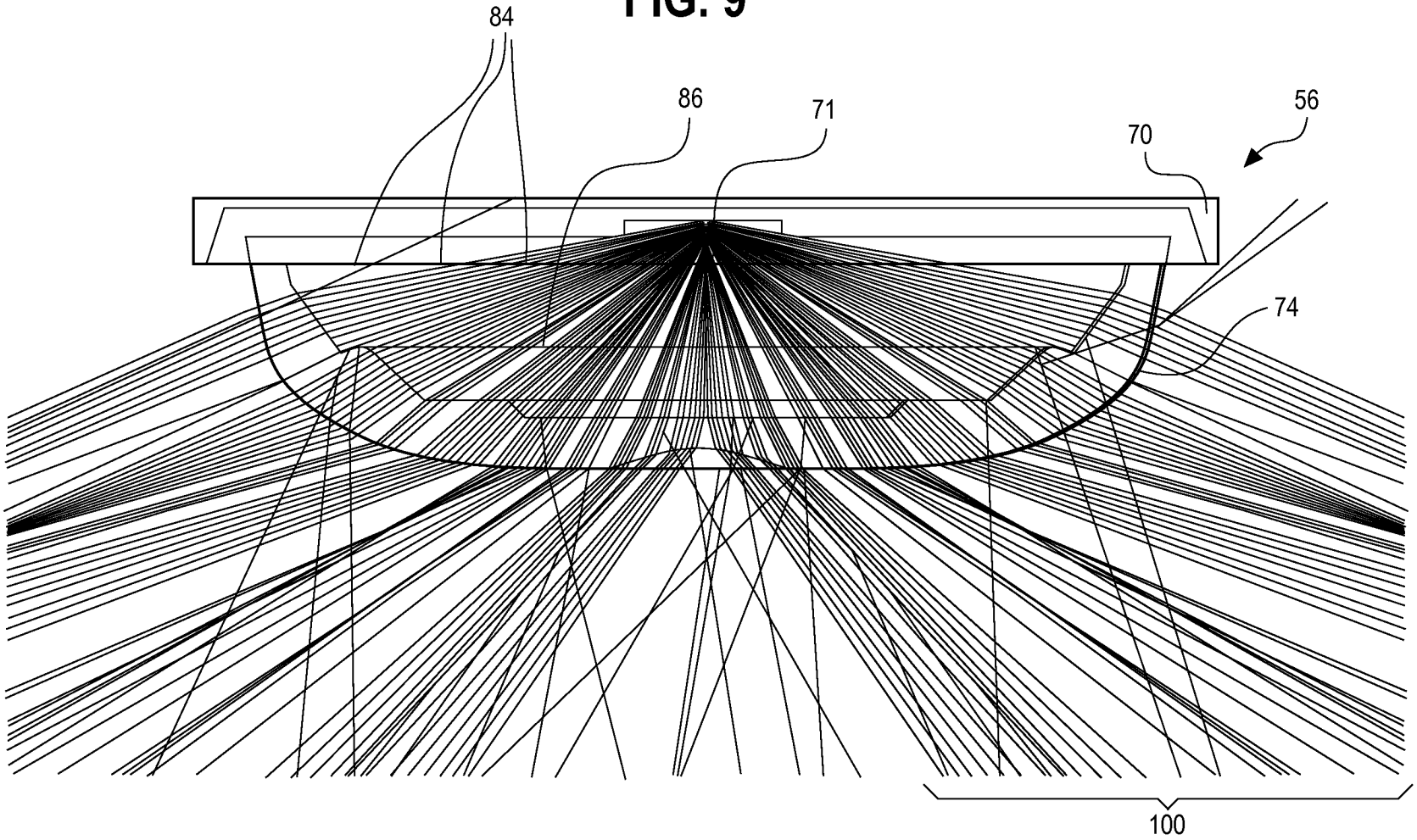
FIG. 9 is a light ray diagram of a further embodiment of an optic.

The light developed by the LED package 52 is incident on the light redirection features 84 and is collimated to some degree and redirected outwardly and away from the central axis 72. As shown by the rays 100 of FIG. 9, the light incident on the redirection features 84 is refracted at the inner surface 86 of the curved portion 68 and refracted again at the outer surface 74 of the curved portion 68. The degree of redirection is determined by a number of factors, including the curvature and shape of the redirection feature(s) 84 and the surfaces 78, 80, 82 that define the indentation 76. In the illustrated embodiment shown in FIGS. 8A and 8B, each optical member has the dimensions recited in the following table, it being understood that the dimensions are exemplary only and do not limit the scope of any claims herein, except as may be recited thereby, together with equivalents thereof:

| REFERENCE | NOMINAL DIMENSIONS (in., unless otherwise specified) |
|---|---|
| FIG. 5 | |
| A | 0.66 (radius of curvature) |
| B | 1.33 (radius of curvature) |
| C | 2.00 (radius of curvature) |
| D | 4.8 (radius of curvature) |
| E | 4.98 (radius of curvature) |
| FIG. 7 | |
| F | 0.2 |
| G | 0.1 |
| H | 1.4 |
| FIG. 6 | |
| J | 0.122 (radius of curvature) |
| K | 4.94 |
| L | 2.24 (radius of curvature) |
| M | 2.49 (radius of curvature) |
| N | 0.20 (radius of curvature) |
| P | 0.669 |
| Q | 2.94 |
| R | 0.35 |
| FIG. 8A | |
| S | 173.0 degrees |
| T | 165.0 degrees |
| U | 155.0 degrees |
| V | 0.38 (radius of curvature) |
| W | 1.00 (radius of curvature) |
| X | 1.50 (radius of curvature) |
| Y | 0.04 (radius of curvature) |
| Z | 0.18 |
| AA | 0.75 (radius of curvature) |
| AB | 0.63 (radius of curvature) |
| AC | 1.00 (radius of curvature) |
| FIG. 8B | |
| AD | 135.0 +/− 2.5 degrees |
| AE | 105.0 +/− 2.5 degrees |
| AF | 80.0 +/− 2.5 degrees |
| AG | 65.2 +/− 2.5 degrees |
| AH | 50.0 +/− 2.5 degrees |
| AJ | 0.02 +/− 0.25 (radius of curvature) |

The optical member 56 has a thickness defined by the inner and outer surfaces 86, 74 that varies. The thickness may range from about 3 mm to about 6 mm, preferably from 3.25 mm to about 5.5 mm, and most preferably from about 3.25 mm to about 5 mm. In some embodiments, the thickness of the curved portion 68 may vary from about 3.7 mm at the indentation 76 to about 4.5 mm at the base 70. Further, the thickness of the optical member 56 at the light redirection features 84 may range from about 0.26 in. (6.604 mm) to about 0.37 in. (9.398 mm). The curved portion 68 may have a first thickness adjacent to the indentation 76 and a second thickness greater than the first thickness adjacent to the light redirection feature 84. The optical member 56 illustrated in FIGS. 3-8 may exhibit an optical efficiency of at least about 75%, preferably at least about 80%, and most preferably at least about 93%.

Figure 10A:
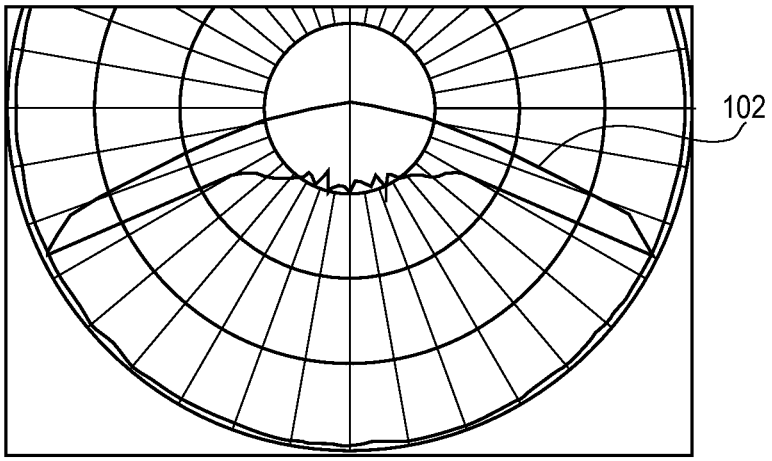
FIGS. 10A and 10B are side elevational and plan views, respectively, of illumination distributions produced by the embodiment of FIG. 3.
Figure 10B:
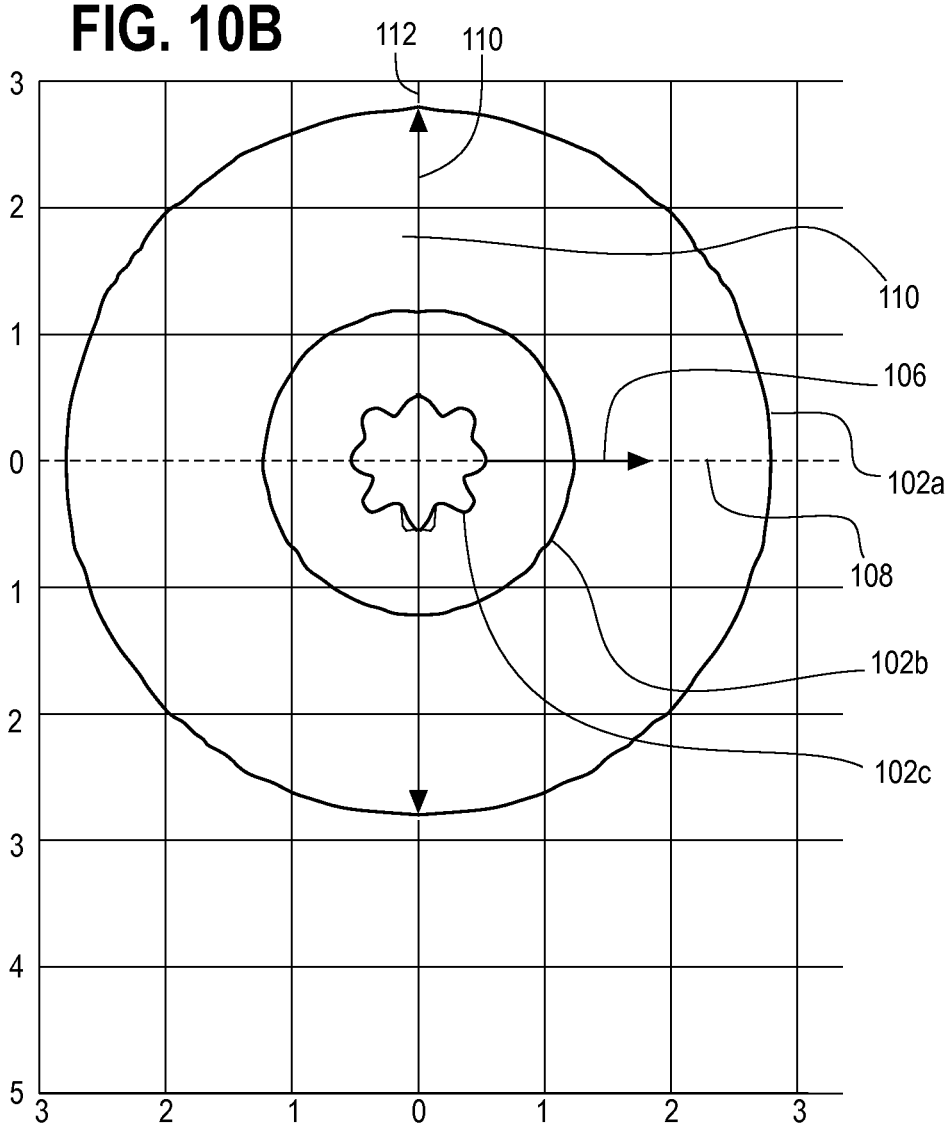

The overall result, when the LED package 52 is energized, is to produce a desired illumination distribution 102, for example, as illustrated by the simulation illumination diagrams of FIGS. 10A and 10B. FIG. 10A illustrates the distribution 102 along a first plane on which the central axis 72 lies. FIG. 10B illustrates the distribution 102 produced along a second plane normal to the central axis 72. The luminaire 50 utilizing the optical member 56 may produce various distributions depending on various parameters such as lumen output and mounting height. For example, as shown in FIG. 10B, the luminaire 50 utilizing the optical member 56 and having a lumen output of about 3,200 lumens may generate about 0.2 foot-candles, about 0.5 foot-candles, and about 1.0 foot-candles of light having first, second, and third distributions 102*a*, 102*b*, 102*c*, respectively, at mounting heights of about 42 feet, about 18.75 feet, and about 7.5 feet, respectively. Each distribution 102*a*, 102*b*, 102*c* of FIG. 10B includes a first extent 106 in an x-direction along an x-axis 108 and a second extent 110 in a y-direction along a y-axis 112 perpendicular to the x-axis 108. The first extent 106 and the second extent 110 are symmetric about the x-axis and y-axis 108, 112, respectively.

FIGS. 11-16 illustrate a further embodiment of an optical member 120 similar to the optical member 56 of FIGS. 3-8 above but having a different shape and illumination distribution. The optical member 120 may be used in the luminaire 20 of FIGS. 1 and 2. It should be noted that, while the optical member 120 is transparent such that all features are visible at all times, the profile of each feature is not always shown in the FIGS. for simplicity.

Figure 11:
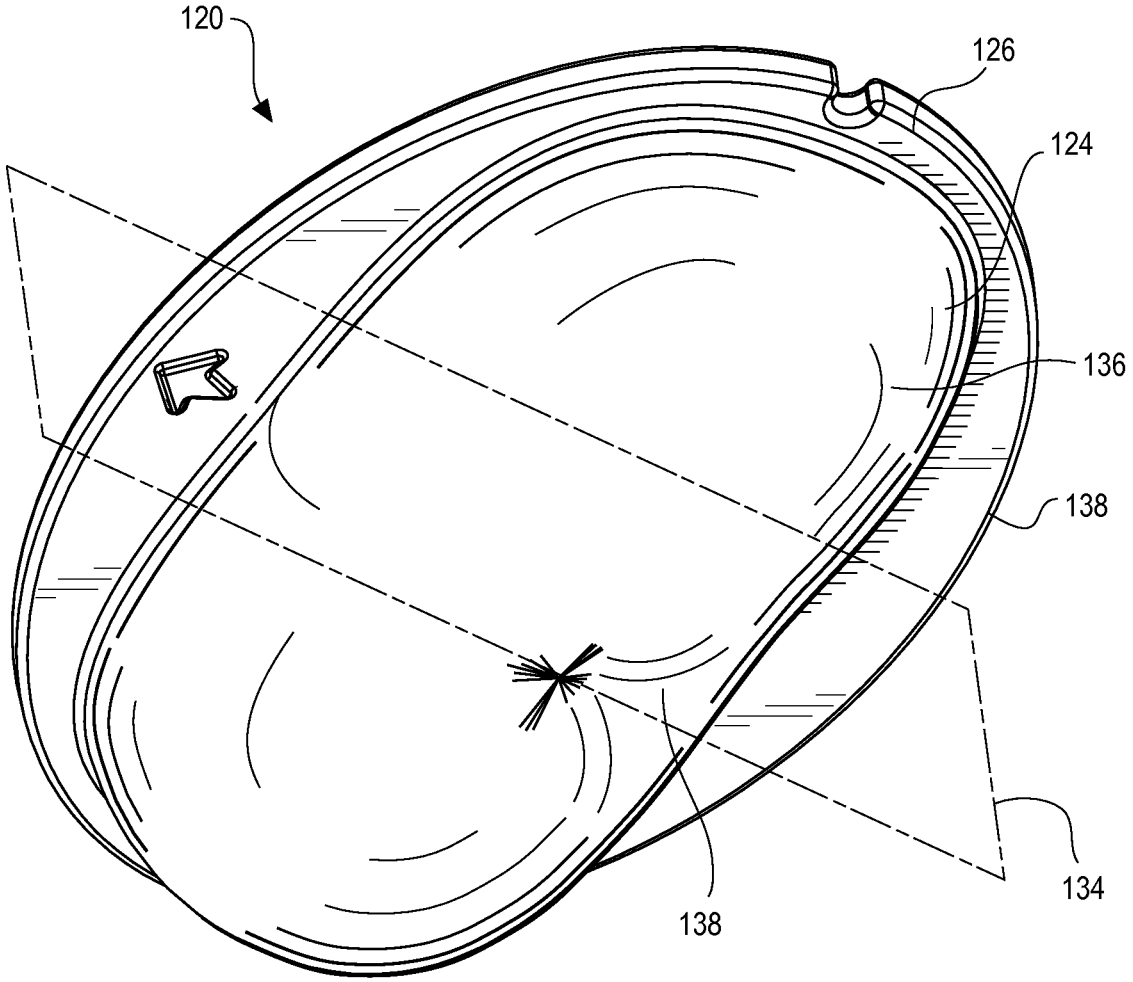
FIG. 11 is an isometric view from below of a further embodiment of an optic.
Figure 12:
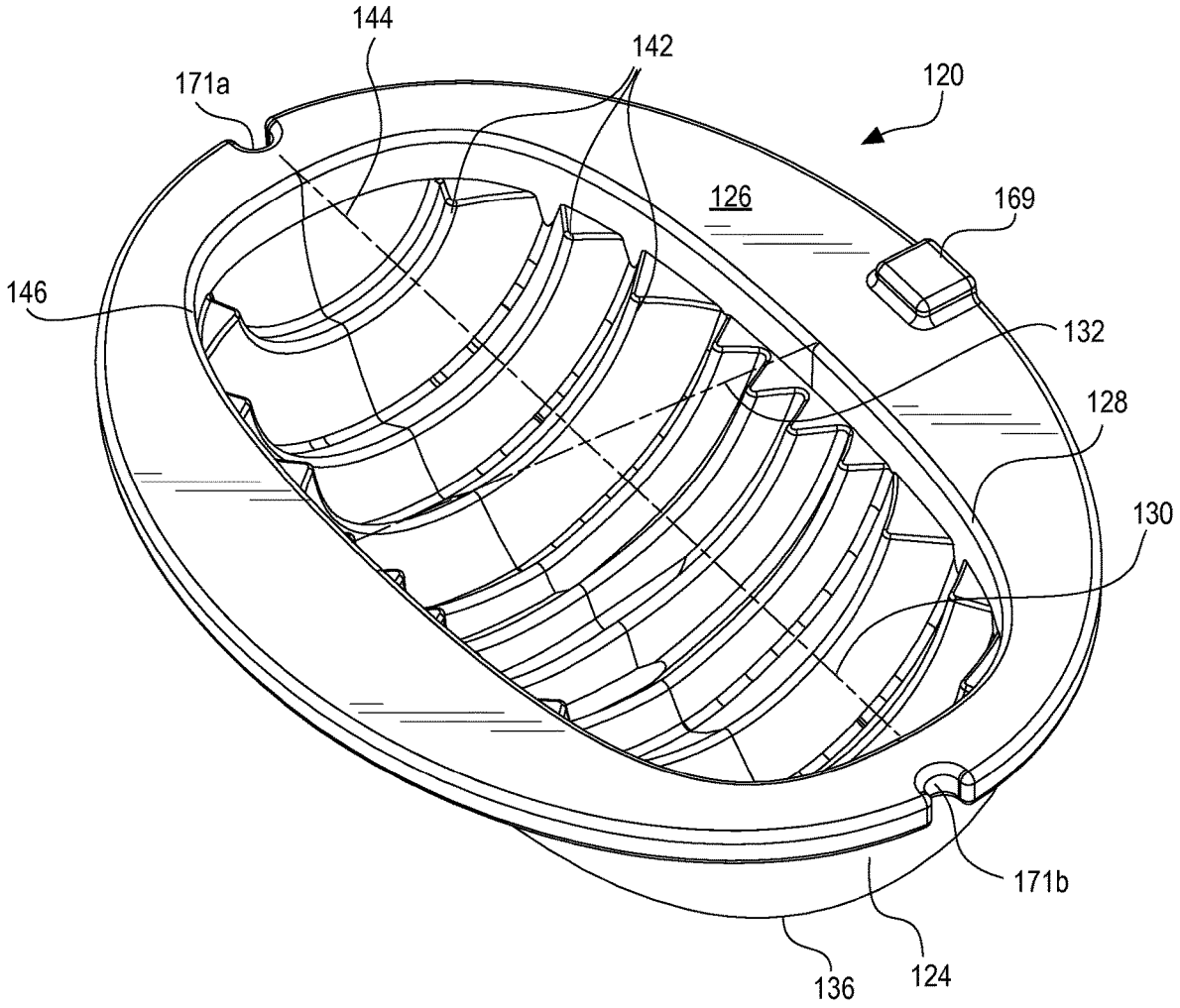
FIG. 12 is an isometric view from above of the embodiment of FIG. 11.
Figure 13:
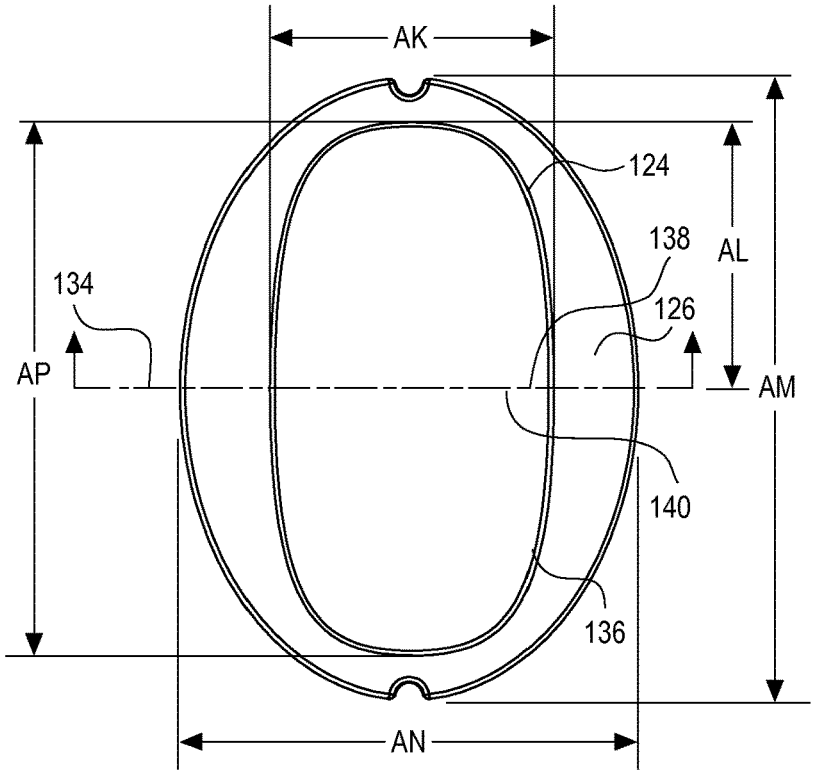
FIG. 13 is a bottom elevational view of the embodiment of FIG. 11.
Figure 14:
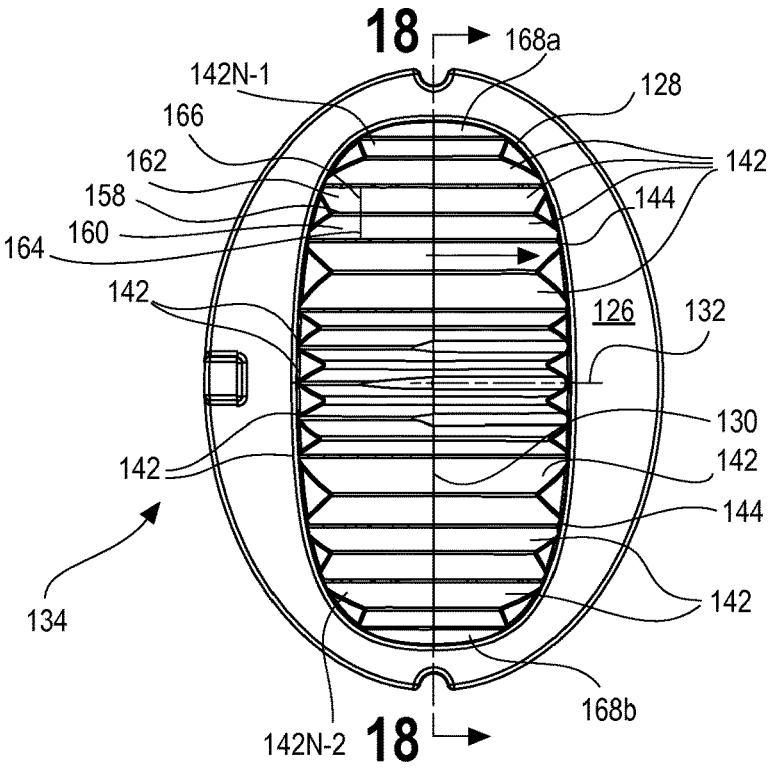
FIG. 14 is a plan view of the embodiment of FIG. 11.

Referring to FIG. 11, the optical member or enclosure 120 includes a curved portion 124 that extends from a base 126. As seen in FIGS. 12 and 14, the curved portion 124 defines an elongate shape 128 at the base 126 having a major axis 130 and a minor axis 132 transverse to the major axis 130. The optical member 120 is symmetric about a plane of symmetry 134 that includes the minor axis 132 and which is normal to the base 126. An outer surface 136 of the curved portion 124 includes at least one indentation 138 that is configured to refract light away from the plane of symmetry 134. As seen in FIG. 13, the indentation 138 is defined at least in part by a line 140 that lies on the plane of symmetry 134.

Referring to FIGS. 12 and 14, a plurality of light redirection features 142 protrudes from an inner surface 144 of the curved portion 124 opposite the outer surface 136. In the illustrated embodiment, each light redirection feature 142 has a curved shape 146 that extends in a linear direction and is parallel to the minor axis 132, although other orientation(s) and/or spacing(s) may be used to produce a desired illumination distribution.

Figure 15:
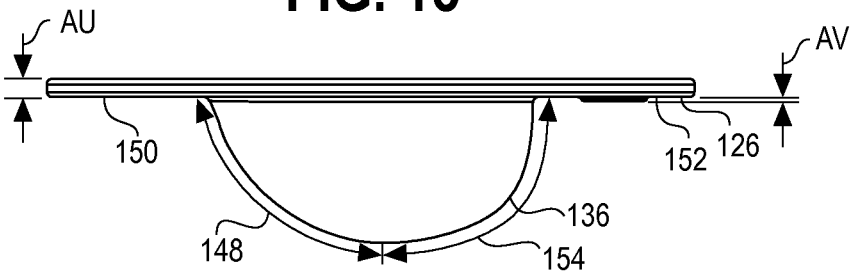
FIG. 15 is a side elevational view of the embodiment of FIG. 11.

As shown in FIG. 15, the outer surface 136 of the curved portion 124 varies between a first side 150 of the optical member 120 and a second side 152 of the optical member 120 opposite the first side 150. The outer surface 136 defines a "free form" or "spline curvature" as described above. In other embodiments, the outer surface 136 may be defined by a specific equation, a curve determined by iteratively plotting the points using a differential or quasi-differential equation, and/or free formed curvature, or a combination thereof. A first extent 148 adjacent the first side 150 has a curvature approximating or defined by a curve having a first radius of curvature, and a second extent 154 adjacent the second side 152 has a curvature approximating or defined by a curve having a second radius of curvature smaller than the first radius of curvature. In one embodiment where the optical member 120 is used for roadway lighting, the optical member 120 is disposed such that the first side 150 is closer to the stanchion or pole 58 (FIG. 1) and the second side 152 is directed toward the roadway (not shown).

Figure 16:
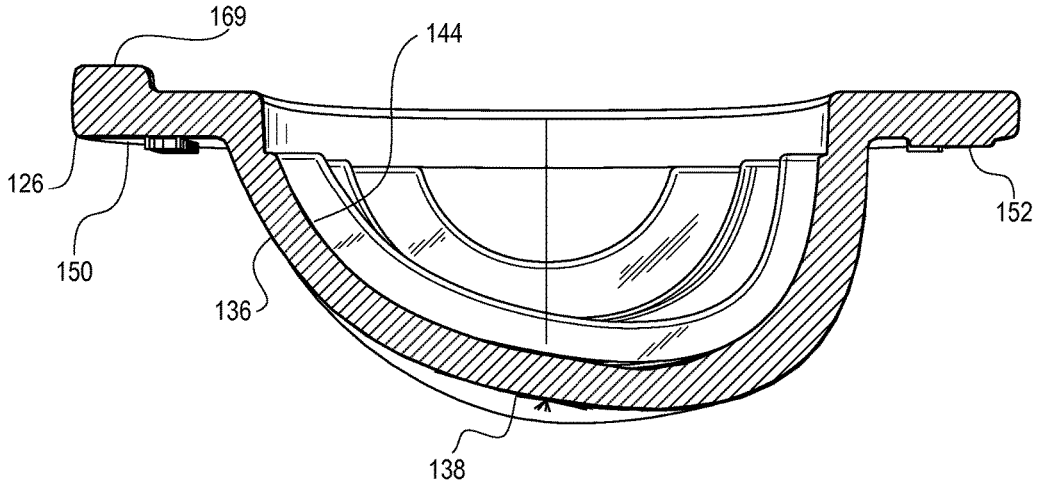
FIG. 16 is a sectional view taken generally along the lines 16-16 of FIG. 13.

As seen in FIG. 16, the indentation 138 is formed along the first and second extents 148, 154. The inner and outer surfaces 144, 136 of the curved portion 124 define a thickness therebetween, which varies along the minor axis 132.

Figure 17:
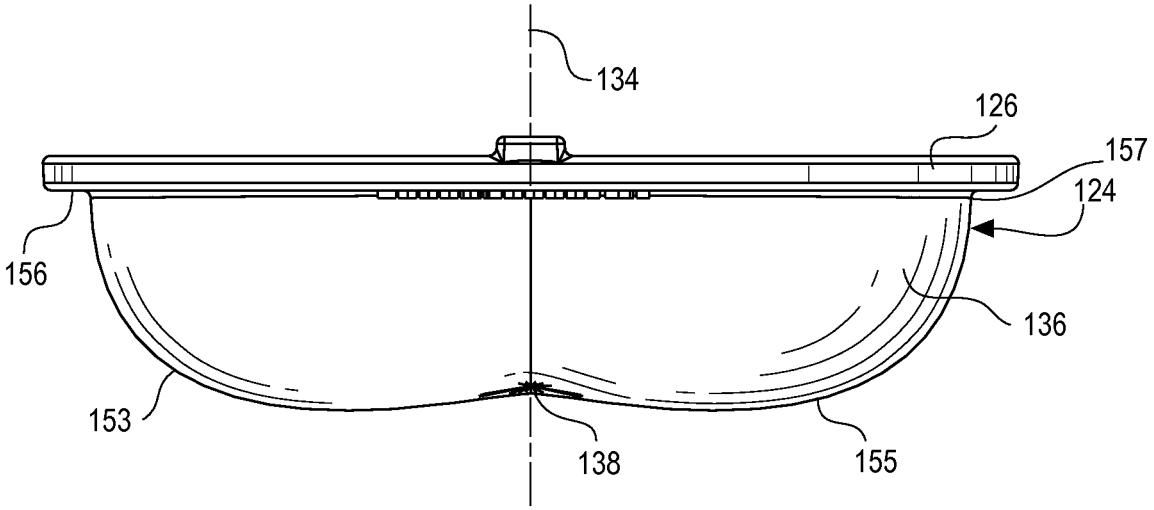
FIG. 17 is a further side elevational view of the embodiment of FIG. 11 transverse to the side elevational view of FIG. 15.

FIG. 17 illustrates the varied curvature of the outer surface 136 of the curved portion 124 viewed from the first side 150. Third and fourth extents 153, 155 of the outer surface 136 of the curved portion 124 adjacent third and fourth sides 156, 157, respectively, of the optical member 120 are mirror images of one another along the plane of symmetry 134. The third and fourth extents 153, 155 of the outer surface 136 are also "free form" or "spline curvatures," although the curvature may be otherwise defined as desired.

Figure 18:
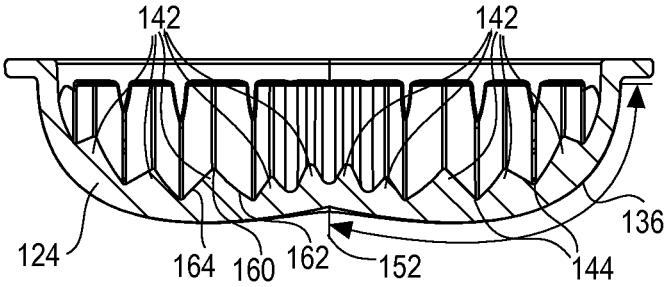
FIG. 18 is a sectional view taken generally along the lines 18-18 of FIG. 14.

As seen in FIG. 18, each light redirection feature 142 of the illustrated embodiment has a ridge shape that includes a ridge 158 defined by an inner feature surface 160 closer to the minor axis and an outer feature surface 162. The ridge 158 may be filleted as seen in cross section having a radius of curvature of between about 0.5 mm and about 2.0 mm, preferably between about 0.75 mm and about 1.5 mm, and most preferably between about 0.85 mm and about 1.2 mm. The inner feature surface 160 may have a finite radius of curvature along a first extent 164 between the inner surface 144 and the ridge 158. The outer feature surface 162 may be planar along a second extent 166 between the inner surface 144 and the ridge 158. The first and second extents 164, 166 may have curved surfaces, planar surfaces, or a combination thereof. Further, first and second portions 168*a*, 168*b* of the inner surface 144 that extend between the outermost light redirection features 142N-1, 142N-2, respectively, and the base 126 may have a finite radius of curvature. Further, in some embodiments, adjacent light redirection features 142 distal to the indentation 138 are spaced farther apart than adjacent light features 142 proximal to the central axis 138.

Similar to the optical member 56 described above, the optical member 120 as seen in FIG. 12 includes a stub 169 extending from the base 126 that applies pressure to the wires 53 in the channel 57 when the luminaire 50 is assembled. Two locating slots 171*a*, 171*b*, each having a semi-circular cylindrical shape, are disposed along an outer edge 173 of the base 126 opposite to one another and equidistant from the stub 169. An adhesive material such as a UV curable silicone adhesive disposed on the inner surface 54*a* of the housing 54 secures the optical member 56 thereto.

The light developed by the LED package 52 is incident on the light redirection features 142 and is collimated to some degree and redirected outwardly and away from the plane of symmetry 134. The degree of redirection is determined by a number of factors, including the curvature and shape of the light redirection feature(s) 142 and the surfaces that define the indentation 138. In the illustrated embodiment shown in FIGS. 14A and 18A, the optical member 120 has the dimensions recited in the following table, it being understood that the dimensions are exemplary only and do not limit the scope of any claims herein, except as may be recited thereby, together with equivalents thereof:

| REFERENCE | NOMINAL DIMENSIONS (in., unless otherwise specified) |
|---|---|
| FIG. 13 | |
| AK | 2.57 |
| AL | 2.28 |

-continued

Figure 14A:
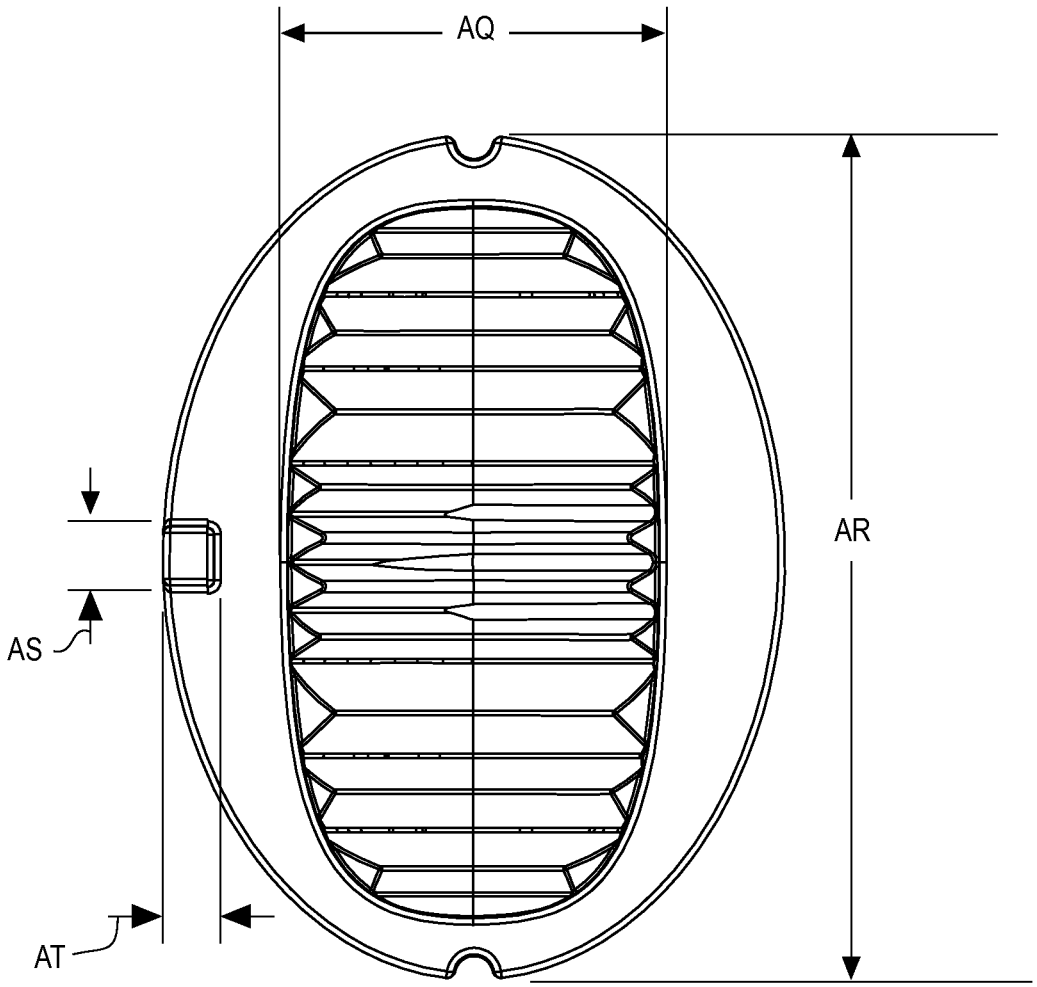
FIG. 14A is a plan view identical to FIG. 14 illustrating sample dimensions for the optical member.
Figure 18A:
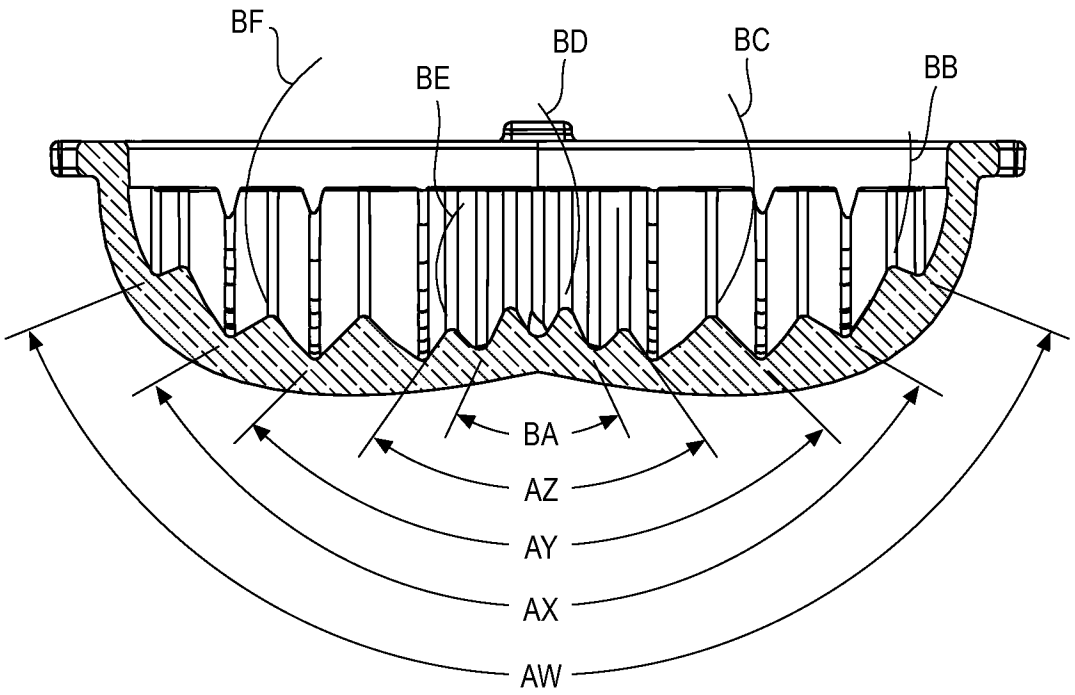
FIG. 18A is a sectional view identical to FIG. 18 illustrating sample dimensions for the optical member.

| REFERENCE | NOMINAL DIMENSIONS (in., unless otherwise specified) |
|---|---|
| AM | 4.97 |
| AN | 3.67 |
| AP | 4.56 |
| FIG. 14A | |
| AQ | 2.20 |
| AR | 4.94 |
| AS | 0.35 |
| AT | 0.29 |
| FIG. 15 | |
| AU | 0.18 |
| AV | 0.10 |
| FIG. 18A | |
| AW | 136.0 degrees |
| AX | 120.0 degrees |
| AY | 90.0 degrees |
| AZ | 70.0 degrees |
| BA | 50.0 degrees |
| BB | 1.5 (radius of curvature) |
| BC | 1.0 (radius of curvature) |
| BD | 1.0 (radius of curvature) |
| BE | 0.5 (radius of curvature) |
| BF | 1.0 (radius of curvature) |

The curved portion 124 of the optical member 120 has a thickness defined by the inner and outer surfaces 144, 136 that varies. The thickness may range from about 3 mm to about 6 mm, preferably from about 3.5 mm to about 5.5 mm, and most preferably from about 4 mm to about 5 mm. Further, the thickness of the optical member 120 at the light redirection features 142 may range from about 0.29 in. (7.366 mm) to about 0.40 in. (10.16 mm). The curved portion 124 may have a first thickness adjacent to the indentation 138 and a second thickness greater than the first thickness adjacent to the light redirection feature 142. The optical member 120 illustrated in FIGS. 11-16 may exhibit an optical efficiency of at least about 70%, preferably at least about 80%, and most preferably at least about 89%.

Figure 19A:
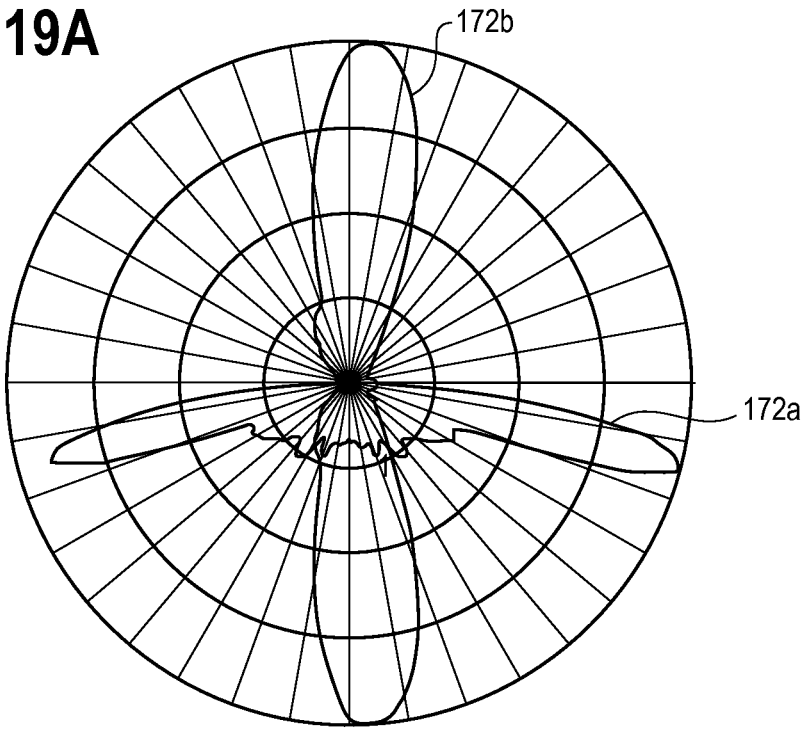
FIG. 19A is a side elevational view and a plan view of an illumination distribution produced by the embodiment of FIG. 11.
Figure 19B:
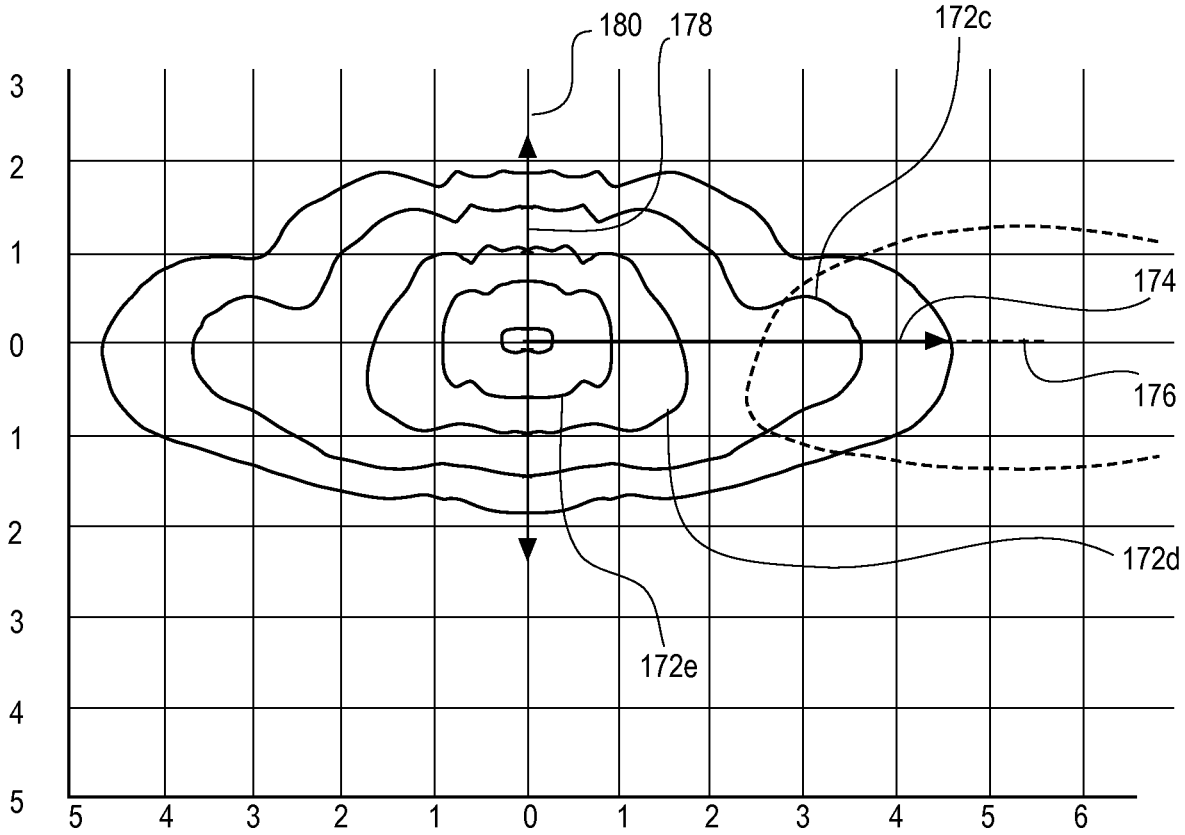
FIG. 19B is a plan view of illumination distributions produced by the embodiment of FIG. 11.

The overall result, when the LED package 52 is energized, is to produce a desired illumination distribution 172, for example, as illustrated by the simulation illumination diagrams of FIGS. 19A and 19B. FIG. 19A illustrates a first distribution 172*a* produced along a first plane on which the major axis 130 lies and is perpendicular to the minor axis 132 and a second distribution 172*b* produced along a second plane parallel to the base 126 on which both of the major and minor axes 130, 132 lie. FIG. 19B illustrates sample distributions 172 produced along the second plane at various mounting heights. Such distributions may also depend on other parameter(s) such as lumen output. For example, as shown in FIG. 19B, the luminaire 50 utilizing the optical member 120 and having a lumen output of about 3,100 lumens may generate about 0.2 foot-candles, about 0.5 foot-candles, and about 1.0 foot-candles of light having first, second, and third distributions 172*c*, 172*d*, 172*e*, respectively, at mounting heights of about 56.25 feet, about 26.25 feet, and about 15 feet, respectively. The distribution of FIG. 19B includes a first extent 174 along an x-axis 176 and a second extent 178 shorter than the first extent 174 along a y-axis 180 perpendicular to the x-axis 176.

Any of the embodiments disclosed herein may include a power circuit having a buck regulator, a boost regulator, a buck-boost regulator, a SEPIC power supply, or the like, and may comprise a driver circuit as disclosed in U.S. patent application Ser. No. 14/291,829, filed May 30, 2014, entitled "High Efficiency Driver Circuit with Fast Response" by Hu et al. or U.S. patent application Ser. No. 14/292,001, filed May 30, 2014, entitled "SEPIC Driver Circuit with Low Input Current Ripple" by Hu et al. incorporated by reference herein. The circuit may further be used with light control circuitry that controls color temperature of any of the embodiments disclosed herein in accordance with viewer input such as disclosed in U.S. patent application Ser. No. 14/292,286, filed May 30, 2014, entitled "Lighting Fixture Providing Variable CCT" by Pope et al. incorporated by reference herein.

Further, any of the embodiments disclosed herein may be used in a luminaire having one or more communication components forming a part of the light control circuitry, such as an RF antenna that senses RF energy. The communication components may be included, for example, to allow the luminaire to communicate with other luminaires and/or with an external wireless controller, such as disclosed in U.S. patent application Ser. No. 13/782,040, filed Mar. 1, 2013, entitled "Lighting Fixture for Distributed Control" or U.S. Provisional Application No. 61/932,058, filed Jan. 27, 2014, entitled "Enhanced Network Lighting" both owned by the assignee of the present application and the disclosures of which are incorporated by reference herein. More generally, the control circuitry includes at least one of a network component, an RF component, a control component, and a sensor. The sensor, such as a knob-shaped sensor, may provide an indication of ambient lighting levels thereto and/or occupancy within the room or illuminated area. Such sensor may be integrated into the light control circuitry.

INDUSTRIAL APPLICABILITY

In summary, the disclosed luminaire provides an aesthetically pleasing, sturdy, cost effective lighting assembly for use in lighting a large area such as a parking lot or deck of a parking garage and/or along a roadway. The lighting is accomplished with reduced glare as compared to conventional lighting systems.

The light redirection features and indentation disclosed herein efficiently redirect light out of the optic. At least some of the luminaires disclosed herein are particularly adapted for use in outdoor or indoor general illumination products (e.g., streetlights, high-bay lights, canopy lights, parking lot or parking structure lighting, yard or other property lighting, rural lighting, walkway lighting, warehouse, store, arena or other public building lighting, or the like). According to one aspect the luminaires disclosed herein are adapted for use in products requiring a total lumen output of between about 1,000 and about 12000 lumens or higher, and, more preferably, between about 4,000 and about 10,000 lumens and possibly higher, and, most preferably, between about 4,000 and about 8,000 lumens. According to another aspect, the luminaires develop at least about 2000 lumens. Further, efficacies between about 75 and about 140 lumens per watt, and more preferably between about 80 and about 125 lumens per watt, and most preferably between about 90 and about 120 lumens per watt can be achieved. Still further, the luminaires disclosed herein preferably have a color temperature of between about 2500 degrees Kelvin and about 6200 degrees Kelvin, and more preferably between about 2500 degrees Kelvin and about 5000 degrees Kelvin, and most preferably between about 3500 degrees Kelvin and about 4500 degrees Kelvin. Further, the optical efficiency may range from about 70% to about 95%, most preferably from about 80% to about 90%. A color rendition index (CRI) of between about 70 and about 80 is preferably attained by at least some of the luminaires disclosed herein, with a CRI of at least about 70 being more preferable. Any desired particular output light distribution, such as a butterfly light distribution, could be achieved, including up and down light distributions or up only or down only distributions, etc.

When one uses a relatively small light source which emits into a broad (e.g., Lambertian) angular distribution (common for LED-based light sources), the conservation of etendue, as generally understood in the art, requires an optical system having a large emission area to achieve a narrow (collimated) angular light distribution. In the case of parabolic reflectors, a large optic is thus generally required to achieve high levels of collimation. In order to achieve a large emission area in a more compact design, the prior art has relied on the use of Fresnel lenses, which utilize refractive optical surfaces to direct and collimate the light. Fresnel lenses, however, are generally planar in nature, and are therefore not well suited to re-directing high-angle light emitted by the source, leading to a loss in optical efficiency. In contrast, in the present invention, light is coupled into the optic, where primarily TIR is used for re-direction and collimation. This coupling allows the full range of angular emission from the source, including high-angle light, to be re-directed and collimated, resulting in higher optical efficiency in a more compact form factor.

In at least some of the present embodiments, the distribution and direction of light within the optical member is better known, and hence, light is controlled and extracted in a more controlled fashion.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A lighting device comprising:

a single-piece optical member comprising:

an optically transmissive material;

a domed outer surface comprising a first portion and a second portion, the second portion varying smoothly from the first portion to an indentation about a central axis of the single-piece optical member;

a refractive inner surface defining a cavity opposite the domed outer surface;

and at least one light redirection feature protruding from the inner surface into the cavity and having a ridge shape.

2. The lighting device of claim 1, wherein:

the indentation is configured to further refract the light refracted by the inner surface.

3. The lighting device of claim 2, wherein to further refract the light, the indentation is configured to refract the light away from the central axis.

4. The lighting device of claim 2, wherein the at least one light redirection feature protruding from the inner surface into the cavity comprises a plurality of light redirection features that are concentric about the central axis.

5. The lighting device of claim 2, wherein the at least one light redirection feature comprises adjacent light redirection features distal to the indentation that are spaced farther apart than adjacent light redirection features proximal to the indentation.

6. The lighting device of claim 2, wherein the single-piece optical member has a varying thickness defined by the inner and domed outer surfaces.

7. The lighting device of claim 6, wherein the single-piece optical member has a first thickness adjacent to the indentation and a second thickness greater than the first thickness adjacent to the at least one light redirection feature.

8. The lighting device of claim 1, wherein the at least one light redirection feature comprises adjacent light redirection features distal to the central axis that are spaced farther apart than adjacent light redirection features proximal to the central axis.

9. The lighting device of claim 1, wherein the at least one light redirection feature is annular in shape.

10. The lighting device of claim 1, wherein the refractive inner surface comprises a plurality of light redirection features, each of which has a ridge shape.

11. The lighting device of claim 1, wherein:

the ridge shape comprises a ridge defined by an inner surface feature and an outer surface feature;

the inner feature surface has a finite radius of curvature along a first distance between the inner surface and the ridge; and the outer feature surface is planar along a second distance between the inner surface and the ridge.

12. The lighting device of claim 1, wherein the optical member defines an elongated shape at a base thereof comprising a major axis and a minor axis transverse to the major axis, and wherein the at least one indentation is defined by a line.

13. The lighting device of claim 12, wherein the line of the at least one indentation is disposed along the minor axis and is configured to refract light away from a plane lying along the minor axis.

14. The lighting device of claim 1, wherein the at least one light redirection feature has a linear extent.

15. The lighting device of claim 14, wherein the at least one light redirection feature is parallel to the minor axis.

16. The lighting device of claim 14, further comprising a plurality of light redirection features, wherein each light redirection feature has a ridge-shape comprising a ridge defined by a first surface and a second surface, the first surface being closer to the minor axis than the second surface, wherein the first surface has a finite radius of curvature along a first distance between the inner surface and the ridge, and wherein the second surface is planar along a second distance between the inner surface and the ridge.

17. The lighting device of claim 1, wherein the single-piece optical member has an optical efficiency of at least about 70%.

18. The lighting device of claim 1, wherein the single-piece optical member has an optical efficiency of at least about 80%.

19. The lighting device of claim 1, further comprising at least one light source, wherein the single-piece optical member is configured to provide an illumination distribution comprising a first extent in an x-direction along an x-axis and a second extent in a y-direction along a y-axis transverse to the x-axis, wherein the first extent and the second extent are symmetric about the x-axis and y-axis, respectively.

20. The lighting device of claim 1, further comprising at least one light source, wherein the optical member is configured to provide an illumination distribution comprising a first extent along an x-axis and a second extent longer than the first extent along a y-axis transverse to the x-axis.

21. The lighting device of claim 1, wherein the optically transmissive material comprises one of glass, acrylic, and polycarbonate material.

22. The lighting device of claim 1, wherein the single-piece optical member has a thickness between the domed outer surface and the inner surface of less than about 6.0 mm.

23. The lighting device of claim 1, wherein the at least one light redirection feature is a refractive light redirection feature.

24. The lighting device of claim 23, wherein the at least one light redirection feature comprises a plurality of light redirection features.

25. The lighting device of claim 1, wherein the at least one light redirection feature redirects light directly to the domed outer surface via refraction.

26. The lighting device of claim 1, wherein the first portion of the domed outer surface has a frustoconical shape.

27. The lighting device of claim 1, wherein the second portion of the domed outer surface has a spline curvature.

28. The lighting device of claim 1, wherein the at least one light redirection feature comprises a concave surface for receiving light from a light source.

29. The lighting device of claim 28, wherein the concave surface is an annular surface about the central axis.

30. The lighting device of claim 29, wherein the at least one light redirection feature redirects light directly to the outer surface via refraction.

31. The lighting device of claim 28, wherein the at least one light redirection feature redirects light directly to the outer surface via refraction.

* * * * *